US006581332B1

(12) United States Patent
Kim

(10) Patent No.: US 6,581,332 B1
(45) Date of Patent: Jun. 24, 2003

(54) REMOTE CONTROLLABLE DEVICE FOR OPENING/CLOSING OF A WINDOW

(76) Inventor: Hak Kyum Kim, 2-101 EunHei Apartment, 686-40, Majeon-dong, Seo-ku, Icheon 404-260 (KR)

( * ) Notice: Subject to any disclaimer, the term of this patent is extended or adjusted under 35 U.S.C. 154(b) by 0 days.

(21) Appl. No.: 09/763,169

(22) PCT Filed: Jun. 12, 2000

(86) PCT No.: PCT/KR00/00613

§ 371 (c)(1),
(2), (4) Date: Apr. 26, 2001

(87) PCT Pub. No.: WO00/79689

PCT Pub. Date: Dec. 28, 2000

(30) Foreign Application Priority Data

| | | |
|---|---|---|
| Jun. 17, 1999 | (KR) | 99-22755 |
| Nov. 2, 1999 | (KR) | 99-48208 |
| Mar. 20, 2000 | (KR) | 2000-07804 U |

(51) Int. Cl.[7] ..... E05F 11/00
(52) U.S. Cl. ..... 49/358
(58) Field of Search ..... 49/25, 358, 360, 49/139, 140

(56) References Cited

U.S. PATENT DOCUMENTS

| | | | | | |
|---|---|---|---|---|---|
| 3,331,428 | A | * | 7/1967 | Ford | 49/358 |
| 3,775,906 | A | * | 12/1973 | Dougherty | 49/358 |
| 4,612,729 | A | * | 9/1986 | Sato | 49/358 |
| 5,036,899 | A | * | 8/1991 | Mullet | 49/358 |
| 5,852,897 | A | * | 12/1998 | Sukale | 49/358 |
| 6,073,394 | A | * | 6/2000 | Uhl | 49/358 |
| 6,087,794 | A | * | 7/2000 | Kawanobe | 49/360 |
| 6,209,264 | B1 | * | 4/2001 | D'Abreu | 49/358 |

* cited by examiner

*Primary Examiner*—Jerry Redman
(74) *Attorney, Agent, or Firm*—McKenna Long & Aldridge LLP

(57) ABSTRACT

The present system includes various mechanisms and devices which may be used to automatically open and close a window. In cooperation with the various mechanisms, a remote controller may be operated to accuate the mechanisms and devices without manual manipulation. In addition to the window mechanism being automatically operated, the system may also operate to lock the window structure to prevent unnecessary stress and overload to the motor, or to prevent unauthorized access and entry through the window.

22 Claims, 19 Drawing Sheets

REMOTE CONTROLLABLE DEVICE FOR OPENING/CLOSING OF A WINDOW

BACKGROUND OF THE INVENTION

1. Field of the Invention

The present invention relates to a device for horizontal opening/closing of a window, and more particularly, to a remote controllable device for automatic opening/closing of a large sized window of a living room or a balcony in an apartment.

2. Background Art

In general, window of the living room or balcony in the apartment is very heavy with a large sized windowpane, which is opened or closed manually, up to now. However, as the industry developed, it is a recent trend that most of home appliances are designed to be controlled by remote controllers, including the window. For example, in large buildings, there is automatic door opening/closing device in which approach of people is detected, and two pieces of transparent glass door panels automatically slide on the same time, which includes sensors fitted at upper side of the door on inside and outside thereof for sensing approach of people. The automatic door opening/closing device is provided with hydraulic cylinders and pistons, and there were door opening/closing devices of motor or rope type.

However, such a slide type automatic door opening/closing device requires two separate sensors fitted at upper side of the door inside and outside thereof, and is opened only when there is an object(people) approaching thereto, and has a problem of much noise when the door is opened/closed. Moreover, such a technology is difficult to apply to the window of the living room or balcony of the apartment, and is not suitable for a quiet room environment as the device has much noise in opening/closing the window.

DISCLOSURE OF INVENTION

Accordingly, the present invention is directed to a remote controllable device for automatic opening/closing of a window that substantially obviates one or more of the problems due to limitations and disadvantages of the related art.

An object of the present invention is to provide a remote controllable device for automatic opening/closing of a window, which can open/close a large sized window of a living room or balcony remotely in an apartment by using a remote controller for noiseless opening/closing of the room and providing a high class room environment.

Other object of the present invention is to provide a remote controllable device for automatic opening/closing of a window which can be repaired with easy.

Another object of the present invention is to provide a remote controllable device for automatic opening/closing of a window, which permit an easy and quiet manual opening/closing of a window.

Further object of the present invention is to provide a remote controllable device for automatic opening/closing of a window, which can reduce a speed of a motor when the window is almost opened/closed, for preventing to give an excessive impact to the window.

Still other object of the present invention is to provide a remote controllable device for automatic opening/closing of a window, which has anti-burglar function in which the device issues an alarm when the window is forced open from outside of the window in a state the window is fully closed.

Still another object of the present invention is to provide a remote controllable device for automatic opening/closing of a window, which can reduce a possible generation of noise from motors to a minimum, and can prevent an overload to the motors.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purposes of the present invention, as embodied and broadly described, the remote controllable device for automatic opening/closing of a window, including a window frame having a rail, and a window panel having a window pane, the window panel movable along the rail of the window frame, includes a power supplying metal terminal for fitted along a rail wall of the window frame for receiving a power, window moving means fitted in a groove of the window panel for receiving the power from the power supplying metal terminal to move the window panel with respect to the window frame, a transmitter for transmitting a remote signal for controlling movement of the window panel remotely, and a control means for receiving a control signal from the transmitter for controlling operation of the window moving means.

The window moving means preferably includes a holder elastically fitted in the groove of the window panel, at least one reversible motor fitted to the holder, a driving member on a shaft fitted to the holder to be rotatable by a driving force of the motor, a roller rotatably mounted on the same axis with the driving member to be guided by the rail of the window frame for moving the window panel with respect to the window frame, a power supplying contact member fitted to the holder to be brought into elastic contact with the power supplying rail for supplying power to the motor, and an elastic member fitted in the groove of the window panel to support the holder elastically for stable guide of the roller along the rail of the window frame.

The window moving means preferably comes into operation only when the transmitter provides a window open and/or window close control signal, for opening/closing the window panel in a horizontal direction.

The motor preferably has a rotating shaft on which a worm is mounted, and the driving member is a worm gear engaged, and rotated with the worm mounted on the rotating shaft of the motor.

The holder preferably has two motors fitted thereto, and rotating shafts of respective motors are coupled with worms to each other, for exerting a low speed and high power, and the roller is preferably rotated as the roller is brought into forced surface contact with the worm gear, a driving member, on the shaft by an elastic force of the spring.

The driving member further preferably includes a magnetic material fitted to one side of the worm gear engaged, and rotated with the worm mounted on the rotating shaft of the motor, and a permanent magnet fitted to one side of the roller facing the magnet material for generating a magnetic force to the magnet material, thereby the roller and the worm gear making a non-contact rotation, to open the window panel by hand.

Though the window moving means may be fitted to a lower groove, the window moving means is fitted to, and driven in an upper groove of the window panel, taking a weight of the window panel into consideration.

In another aspect of the present invention, there is provided a remote controllable device for automatic opening/ closing of a window, including window moving means detachably fitted on outside of the window panel for rotating the roller guided along the rail of the window frame to move the window panel in a horizontal direction with respect to the window frame automatically, a remote control transmitter for transmitting a remote signal for controlling movement of the window panel remotely, and a control means for receiving a control signal from the transmitter for controlling operation of the window moving means.

The window moving means includes first and second window moving means detachably fitted to an outside of a lower portion of the window panel at open side and close side of the window panel for easy opening and closing of the window, each preferably including a base member fixed to outside of the window panel, rotating force generating means fixed to the base member having the other end rotatable centered on one end for generating a rotating force during automatic opening/closing of the window panel, roller rotating means for transmitting the rotating force generated at the rotating force generating means to the roller to rotate the roller for automatic opening and closing of the window panel, elevating means for engaging the rotating force generating means to the roller rotating means to transmit the rotating force from the rotating force generating means to the roller rotating means in automatic opening/closing of the window panel, and for disengaging the rotating force generating means from the roller rotating means for preventing the rotating force from the rotating force generating means from being transmitted to the roller rotating means in stop of the automatic opening/closing or the window panel and manual opening, and a cover for protecting the above recited means from outside.

The base member includes a first base plate fitted to an outside of the window panel directly, and a second base plate spaced a distance from the first base plate, wherein a plurality of attenuating members fitted between the first base plate and the second base plate, for attenuating impact transmitted to the second base plate during opening/closing of the window panel.

The rotating force generating means preferably includes a holder fitted to the second base plate of the base member having one end centered on which the other end is rotatable, at least two reversible motors for generating the rotating force in automatic opening/closing of the window panel, a worm mounted on a rotating shaft of the motor, and an elevating rod fitted to the other end of the holder, and connected to the elevating means.

The roller rotating means preferably includes a worm gear rotatably fitted to a bracket formed on the second base plate of the base member, and a rotating shaft fixed to the worm gear for rotating the roller, the elevating means preferably includes a solenoid, each of the window moving means further includes delay means for putting the rotating force generating means into operation for generating the rotating force after a preset time period is passed since the rotating force generating means is engaged with the roller rotating means by operating the elevating means first in an initial automatic opening/closing of the window panel, and there is window moving speed reducing means for reducing a moving speed of the window panel when the window panel is almost closed or opened in automatic opening/closing of the window panel by the remote controller, for preventing giving an excessive impact to the window in the remote controllable device. The window moving speed reducing means includes, lead switches fitted to the window moving means respectively, and magnets fitted to the window frame.

Operation of the motor and the solenoid is controlled by a signal sensed by the lead switch in the window moving means fitted to an open side of the window in opening the window panel by the transmitter, and operation of the motor and the solenoid is controlled by a signal sensed by the lead switch in the window moving means fitted to a close side of the window in closing the window panel by the transmitter, however, the window can be opened/closed by hand irrespective of the signal sensed by the lead switches in a manual open/close of the window.

In other aspect of the present invention, there is provided a window moving device for use in a remote controllable device for automatic opening/closing of a window, the remote controllable device including a window frame having a rail, a roller rotatably fitted in a groove of a window panel having a window pane movable along the rail for opening/closing the window panel, and a spring for elastic surface contact pressing of the roller to the worm gear for stable guide of the roller along the rail of the window frame, the window moving device including a holder fitted in a groove at a lower side of the window panel, at least one reversible motor fitted to the holder, a worm on a shaft mounted to a bracket on a holder for engagement with the worm gear for rotating the worm gear, and a rotating force transmitting members fitted to the rotating shaft of the motor and one end of the shaft of the worm.

Although the rotating force transmitting member preferably includes a first pulley mounted on the rotating shaft of the motor, a second pulley mounted on the worm, and a belt for connecting the first and second pulleys, the rotating force transmitting member may includes a first gear mounted on the rotating shaft of the motor, and a second gear fitted to the worm. Two motors and two rotating force transmitting members are fitted in the holder for rotating the worm.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
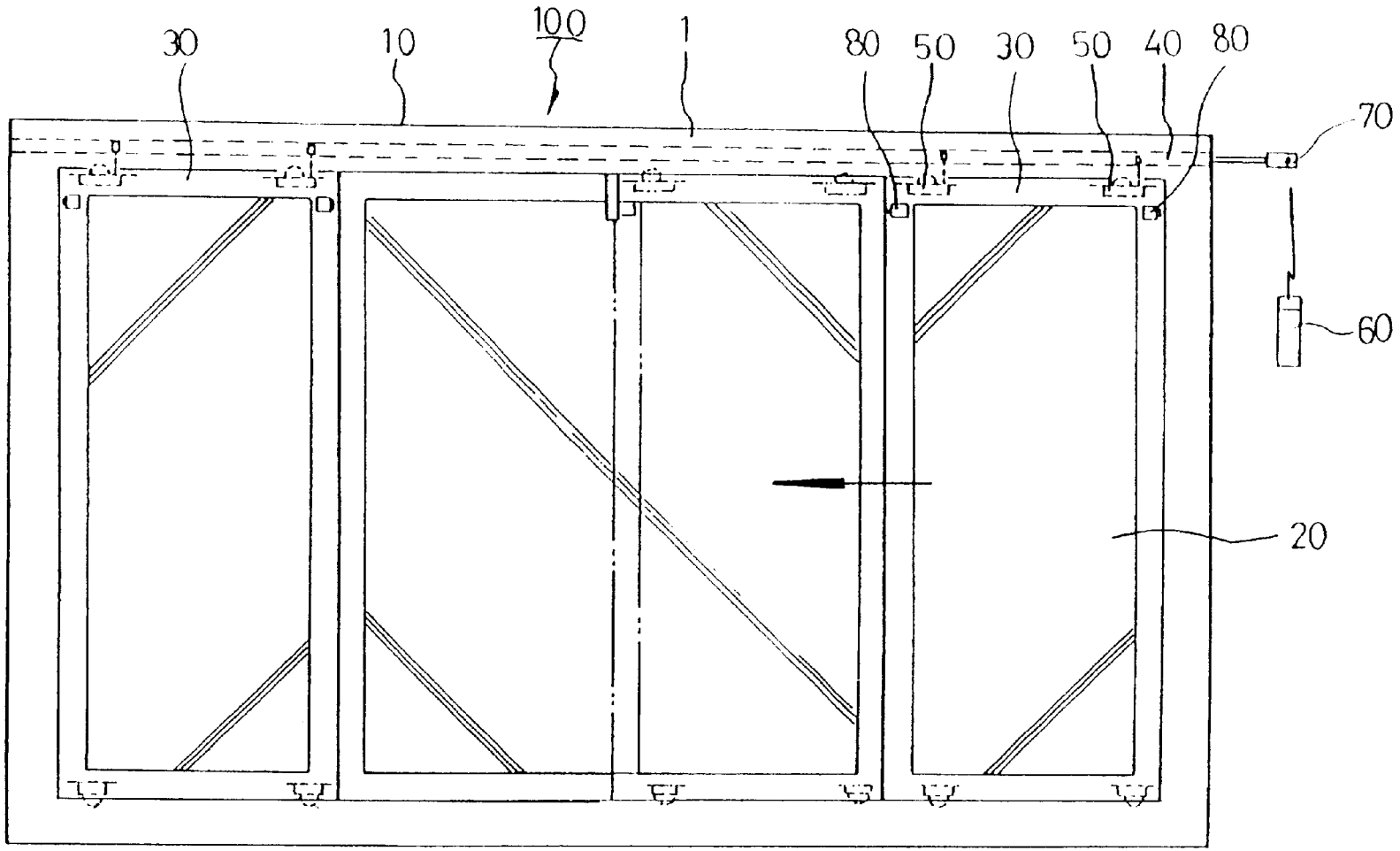
FIG. 1 illustrates a front view of a balcony window having remote controllable device for automatic opening/closing of a window in accordance with a first preferred embodiment of the present invention applied thereto, for showing opening/closing state of the window, schematically.
Figure 2:
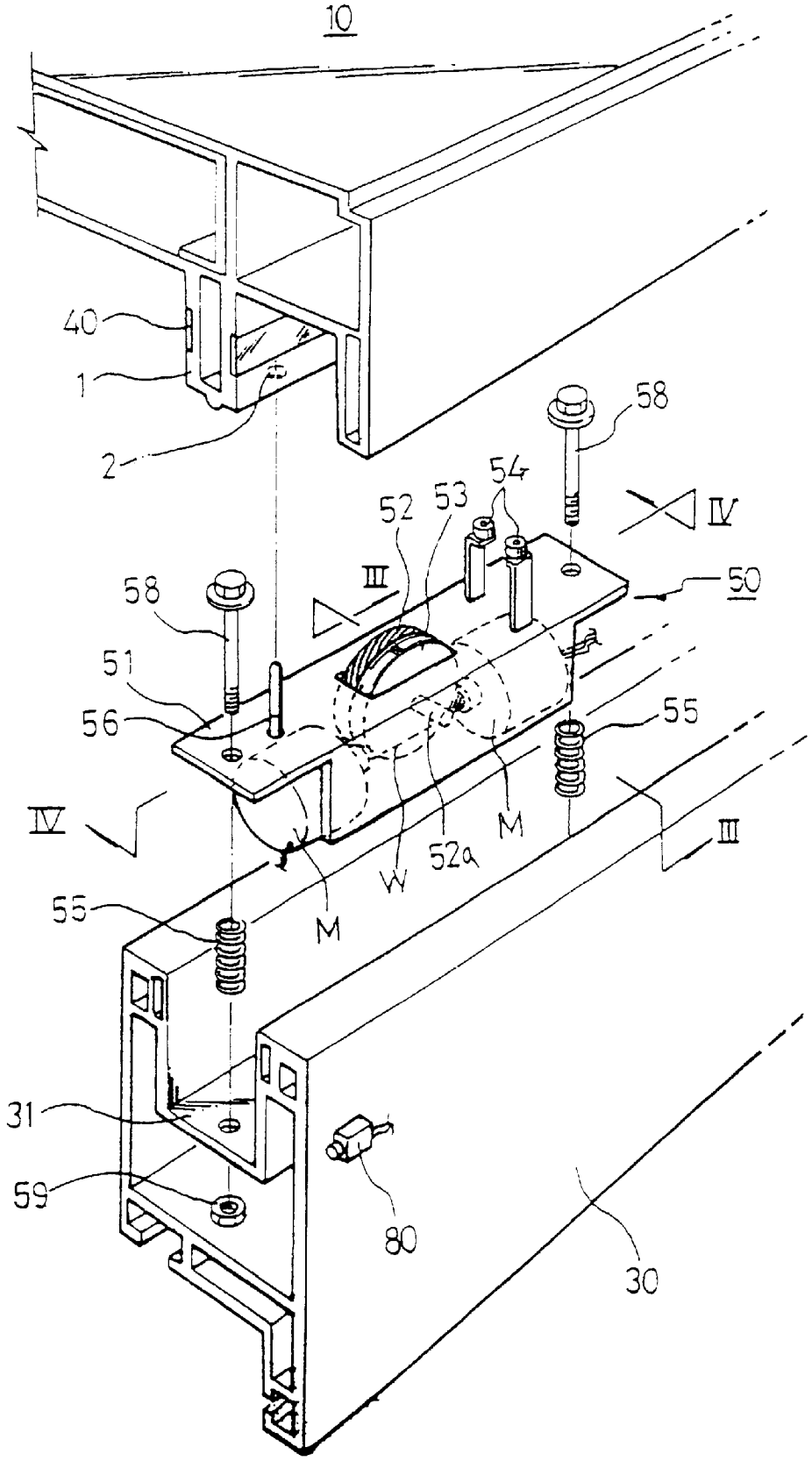
FIG. 2 illustrates a system of a remote controllable device for automatic opening/closing of a window in accordance with a first preferred embodiment of the present invention.

FIG. 1 illustrates a front view of a window 100 having remote controllable device for automatic opening/closing of a window panel in accordance with a first preferred embodiment of the present invention applied thereto schematically, inclusive of a window frame 10 having a rail 1, and a window panel 30 having a window pane 20 fitted thereto for moving along the rail 1 in the window frame 10. In the first embodiment of the present invention, a window moving means 50 as shown in FIG. 2 is fitted to an upper portion of the window panel 30 for remote opening/closing of the window panel 30 by using a remote controller 60. Even though the window automatic opening/closing devices of the present invention are fitted to left and right sides of an upper portion of the window panel 30 in FIG. 1, FIG. 1 is shown as an example only, and does not limit the present invention. For example, of course, it is possible that only one of the window automatic opening/closing devices of the present invention may be fitted to a central portion of the upper portion of the window panel 30 while rollers are rotatably fitted to left and right portions of the upper portion of the window panel 30, or the window automatic opening/closing devices of the present invention may-be fitted either to the left or right portion of the upper portion of the window panel 30 while only a roller is rotatably fitted to rest of the left or right portion of the upper portion of the window panel 30. However, as shown in FIG. 1, it is assumed that the window automatic opening/closing devices of the present invention are fitted to the left and right portions of the window panel 30 respectively, considering that the window panel 30 with the heavy window pane is very heavy, and to help understanding the specification. Accordingly, it is assumed that the window 100 in FIG. 1 has a large sized fixed window panel.

FIG. 2 illustrates a disassembled perspective view of the window moving means 50 which is essential to the first preferred embodiment of the present invention, wherein a metal terminal 40 for supplying a DC power(for example, 12~30V) to motors explained later is fitted to the window frame 10 along a rail 1 wall on the window frame 10. As shown in FIG. 2, the window moving means 50 is fitted in an upper groove 31 of the window panel 30, for receiving a power from the metal terminal 40 to make the window panel 30 to slide with respect to the window frame 10. The window moving means 50 includes a holder 51 for flexible fitting in the groove 31 of the window. 30, and two motors M rotatable in regular and reverse directions. And, the window moving means 50 further includes a driving member 52 with a shaft rotatably fitted to the holder 51 by the driving force of the motors M, and a roller 53 rotatably fixed to the same shaft with the driving member 52 so as to be guided by the rail 1 on the window frame 10 for sliding the window panel 30 with respect to the window frame 10. The holder 51 has contact members 54 for making elastic contact with the terminal 40 for supplying power to the motors M.

Figure 4:
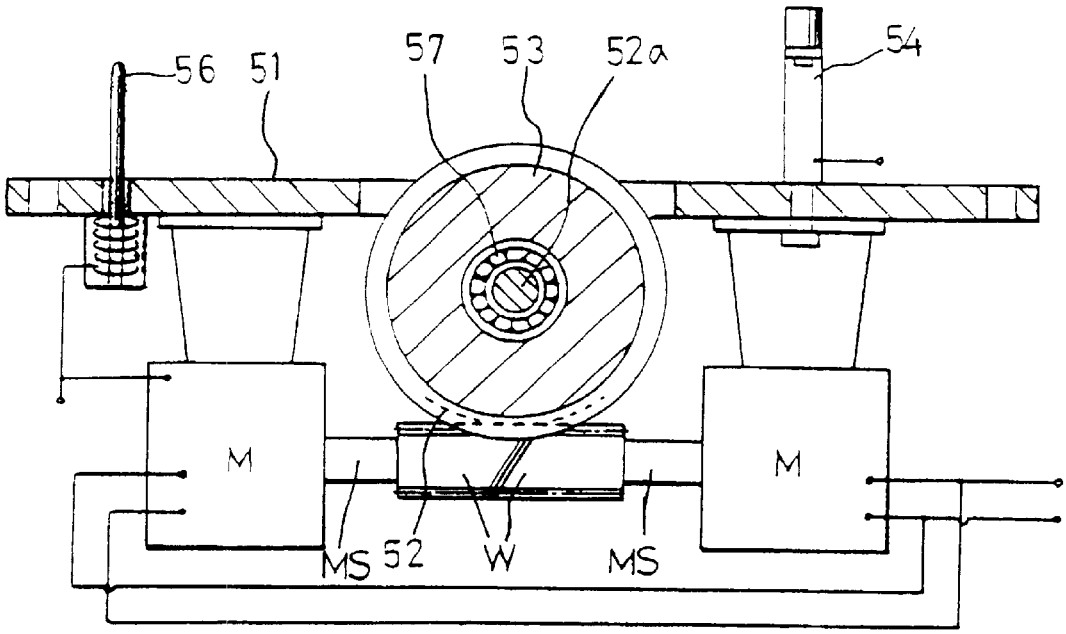
FIG. 4 illustrates an enlarged, assembled, and sectional view across line IV—IV.

Referring to FIG. 4, it is preferable that each of rotating shafts MS of the motors M has a worm W, and the driving member 52 has a worm gear engaged with the worm W on the rotating shaft MS of each of the motors M. And, the rotating shaft MS of the motors are connected to each other by means of worm W for exerting a strong driving force.

Figure 3:
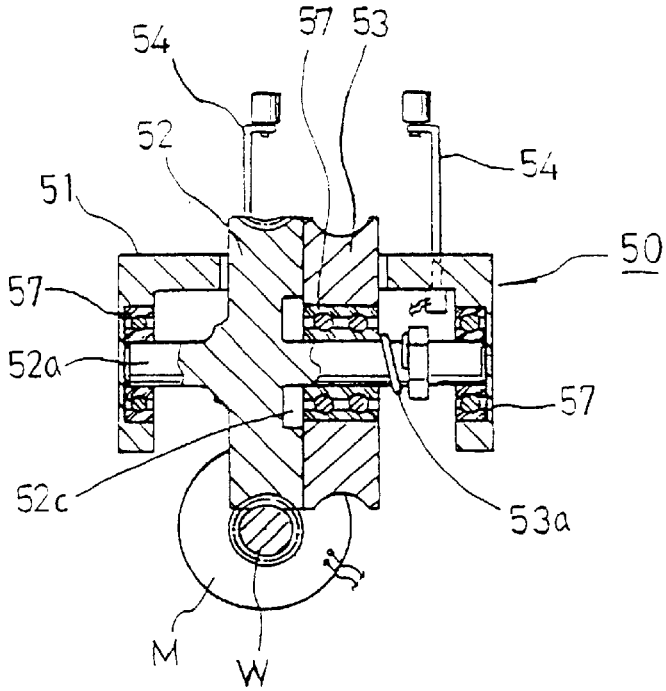
FIG. 3 illustrates an enlarged section across line III—III in FIG. 2 showing window moving means.

And, as shown in FIG. 3, the roller 53 is designed to be brought into forced surface contact with the worm gear 52, a driving member, on the same shaft 52*a* by the elastic force of the spring 53*a*, for rotation with the worm gear 52. Accordingly, when the motors are in operation, the roller 53 comes to close contact with the worm gear 52, and is rotated together with the worm gear 52, and, when the motors M are electrically not in operation(i.e., when it is intended to open the window by hand), though the worm gear 52 is not rotated, the roller 53 can be rotated when the window is opened by hand because the roller 53 is pressed fitted to the shaft 52*a* with a bearing 57 in between. As shown in FIG. 3, it is preferable that the worm gear 52 has an appropriate sized groove 52*c* for minimizing friction between the worm gear 52 and the roller 53 when the window is opened by hand. And, as shown in FIG. 3, it is preferable that the gear shafts 52*a* are provided with bearings 57 for smooth rotation of the shafts 52*a*.

Figure 5:
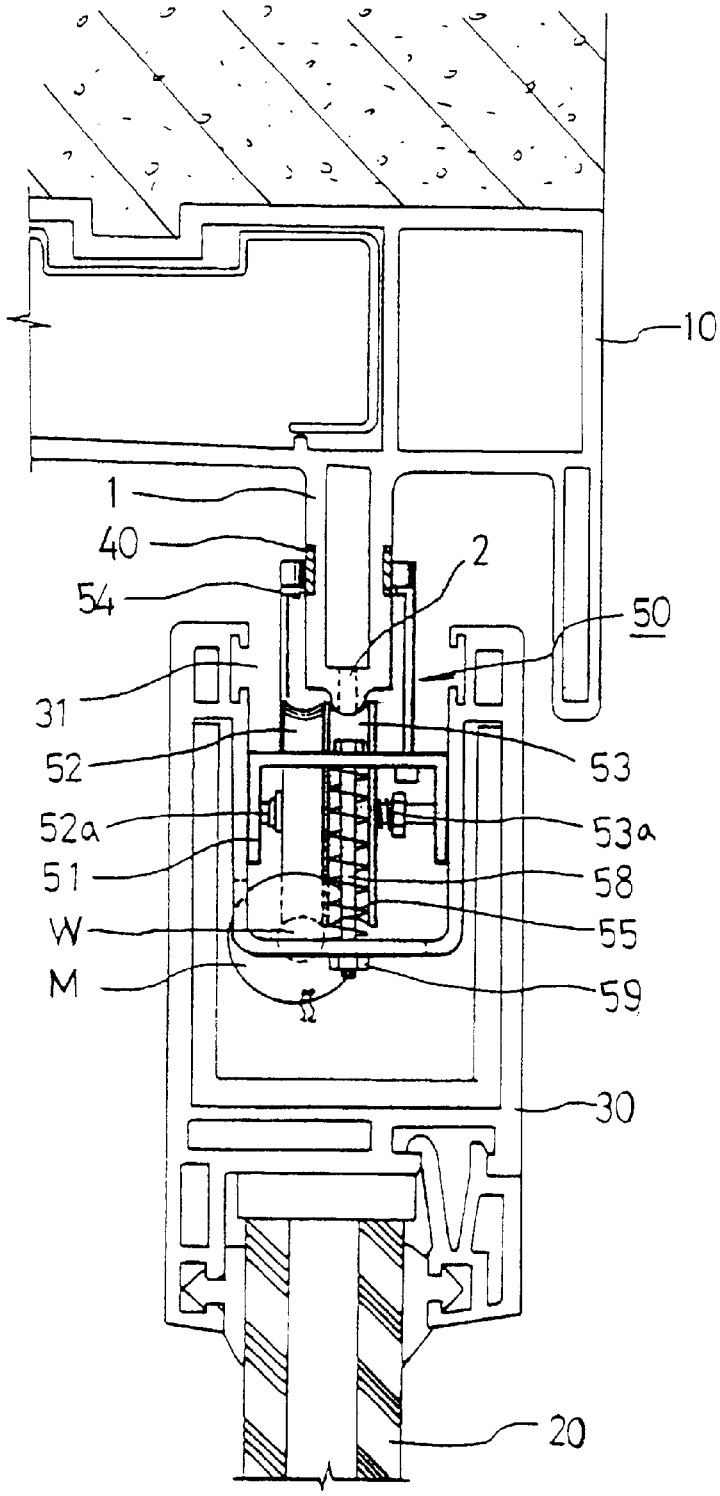
FIG. 5 illustrates a side, assembled, and sectional view of a remote controllable device for automatic opening/closing of a window in accordance with a first preferred embodiment of the present invention.

Referring to FIG. 2 again, there are elastic members 55 in the groove 51 of the window panel 30 fastened by bolts 58 and nuts 59 for elastic support of the holder 51 within the groove 31 for stable guidance of the roller 53 along the rail 1 of the on the window frame 10 as shown in FIG. 5. And, as shown in solid lines in FIG. 1, a locker 56 is provided for locking the locker 56 into an opening 2 in the window frame 30 when the window panel 30 is closed fully, for preventing opening of the window panel 30, wherein the locker 56 is preferably operative by a solenoid. As shown in FIG. 4, it is preferable that the lockers 56 are connected to the same power lines to the motors M for automatic unlocking with respect to the window frame 10 when the window moving means 50 is put into operation(when it is intended to open the window).

For preventing waste of power by stopping operation of the window moving means 50 when the window panel 30 is opened or closed fully, or, as will be explained later, for preventing overload to the motors M coming from unintentional continued pressing of a close or open button on the remote controller 60 despite the window panel 30 is fully opened or closed, as shown in FIGS. 1 and 2, the window panel 30 is provided with a switch 80(for example, microswitch).

Figure 6:
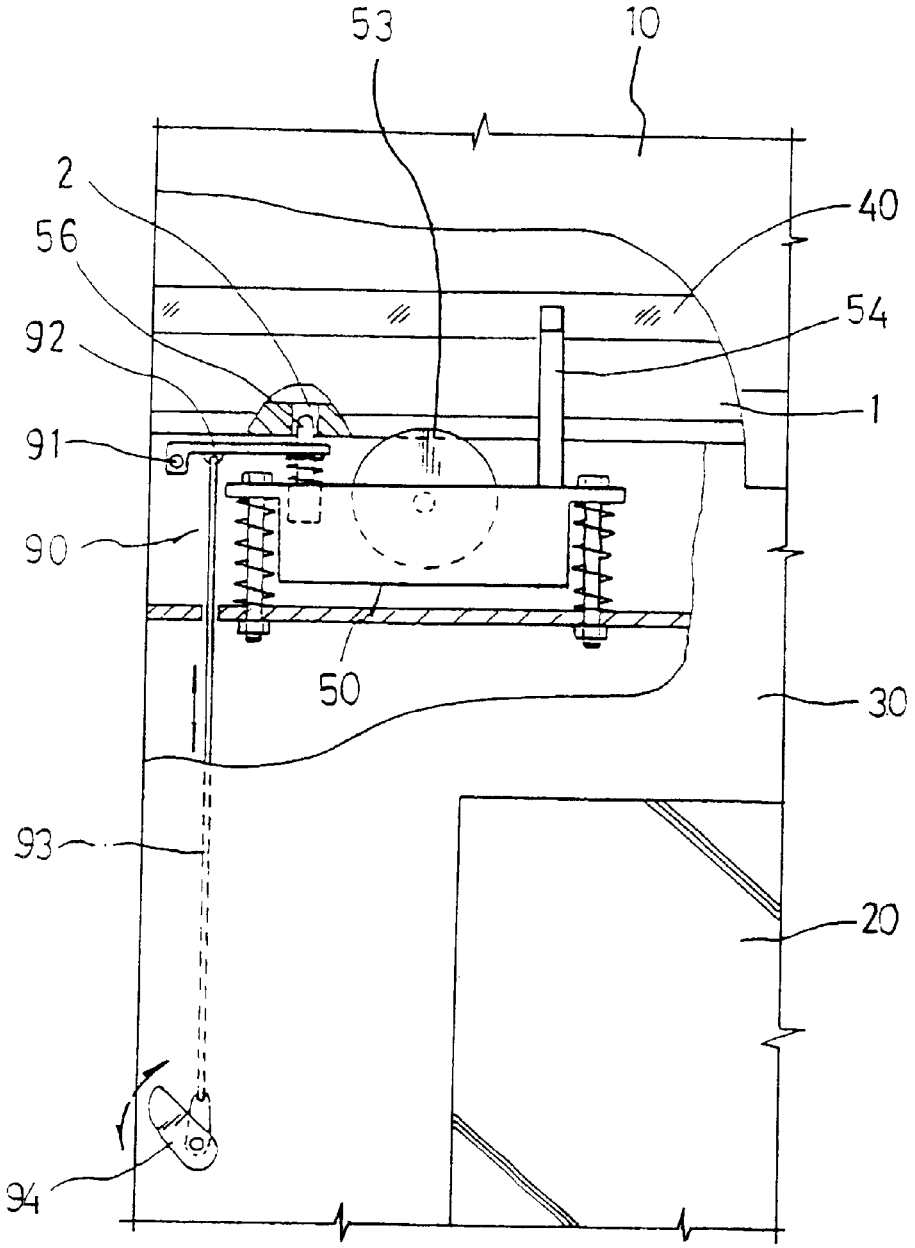
FIG. 6 illustrates a front view with a partial cut away view of a window for showing a locker unlocking structure when a manual opening of the window is required in the remote controllable device for automatic opening/closing of a window in accordance with a first preferred embodiment of the present invention.

FIG. 6 illustrates an unlocking means 90 for manual unlocking of the locker 56 for opening the window panel 30 by hand, inclusive of an actuating bar 92 rotatable on a hinge 91, and a lever 93 and a handle 94 for operating the actuating bar 92. The handle 94 in the unlocking means 90 is preferably fitted to a height people can handle the locker 56 with easy.

Figure 7:
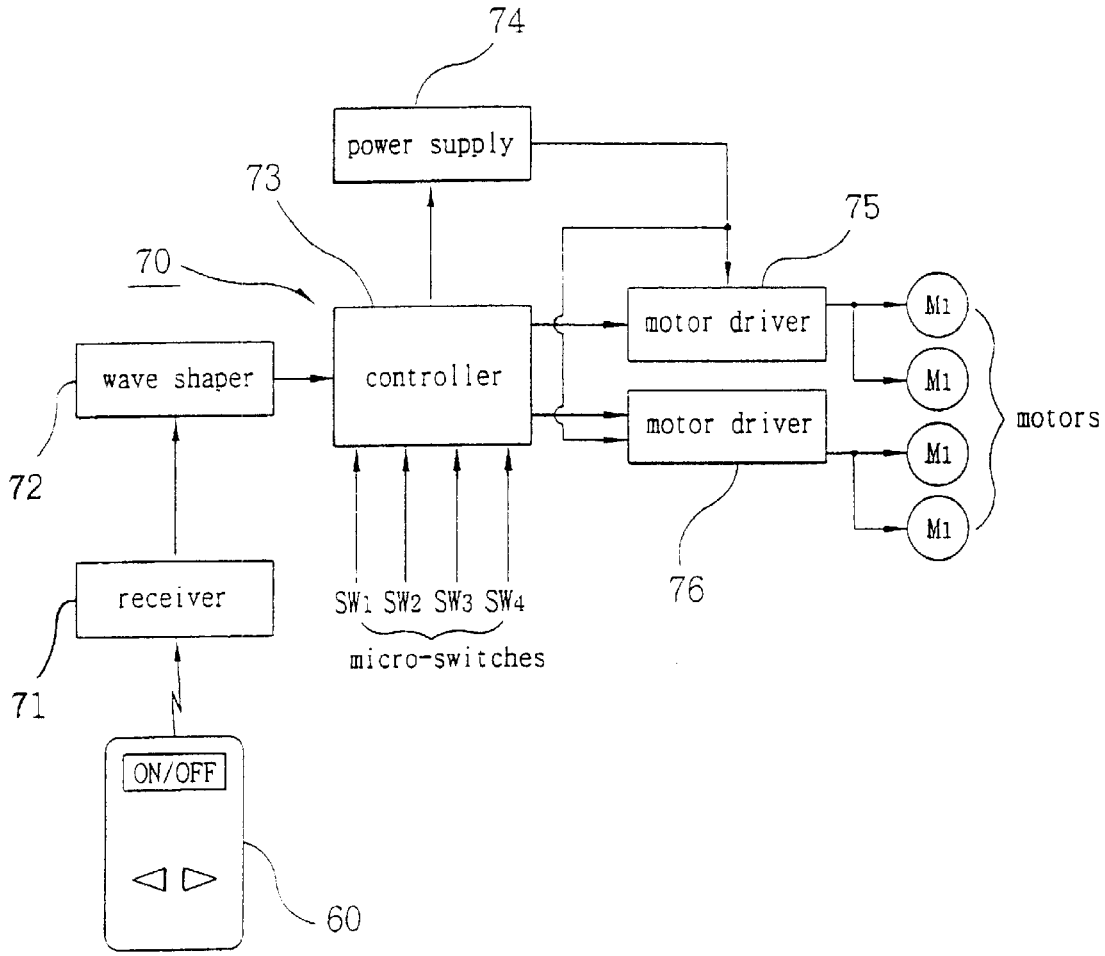
FIG. 7 illustrates a block diagram for showing an automatic remote control of the window in accordance with a first preferred embodiment of the present invention.

FIG. 7 illustrates a block diagram for remote control of the window, inclusive of a receiver 71 in a control means 70 for receiving a power signal, and open/close control signal for controlling operation of the window moving means 50, and a controller 73 for receiving signals required for control after the signals are subjected to wave shaping at the wave shaper 72 for controlling a power device 74 and motor drivers 75 and 76.

The operation of the aforementioned window moving device in accordance with a first preferred embodiment of the present invention will be explained only for the right side window panel in FIG. 1.

When it is intended to open the window panel 30 closed as shown in solid lines in FIG. 1, when the user presses the power switch(ON/OFF) on the remote controller 60, the controller 73 in FIG. 7 enables the power device 74 and the motor driver 75. Under this state, when the user keeps pressing the window open button ◀ on the remote controller 60, power is provided to the motors through the power supply terminals 40 on both sides of rail 1 wall of the window frame 10, as the power supply contact members 54 are kept an elastic contact with the terminals 40. According to this, the motors M start to rotate in regular directions, to rotate the worms W on the shafts MS of the motors M shown in FIG. 4. As the worms W rotate, the worm gears 52 engaged with the worms W rotate, to rotate the rollers 53 brought into a contact with one side of the worm gear 52 forced by the compression spring 53*a* compressed on the shaft 52*a*, that moves the window panel 30 in an arrow direction shown in FIG. 1. If the window open button ◀ is released in the middle of the movement of the window panel 30, the power to motors M is cut off, to stop the motors M, to stop the window panel 30, too. However, if the window panel 30 is opened fully as shown in two dotted lines in FIG. 1 by operating the motors, the switch 80 comes into operation, to cut the power to the motors automatically, for preventing overload on the motors M.

In the meantime, if it is intended to close the window in a state the window is opened fully as shown in the two dotted line in FIG. 1, after the user presses the power switch(ON/OFF), to enable the power device 74 and the motor drivers, if the user keeps to press the window close button ▶ on the remote controller 60, the power is provided to the motors M, to rotate the motors in a reverse direction, when the worms W on the rotation shafts MS of the motors M and the worm gears 52 engaged thereto shown in FIG. 4 are rotate in a reverse direction, together with the rollers 53 brought into contact with one side of the worm gear 52 forced by the compression spring 53*a* compressed on the shafts 52*a*, to move the window panel 30 in a direction opposite to the direction of the arrow in FIG. 1. If the window close button ▶ is released in the middle of movement of the window panel 30, the power to the motors is cut off, to stop the motors, the window panel 30 also stops the closing movement. However, if the motors are kept to be operative until the window panel 30 is closed fully as shown in solid lines in FIG. 1, the switch 80 is operated, to cut the power to the motors M, automatically.

Thus, the first embodiment of the present invention permits to open/close the window remotely from a distant place by using the window open/close button ◀/▶ on the remote controller 60, requires to release the pressed window open/close button ◀/▶ if the window is opened/closed to a desired extent because the window is opening/closing while the window open/close button ◀/▶ on the remote controller 60 is pressed, can prevent overload because the microswitches come into operation when the window panel is fully opened/closed, to cut off the power, and helps preventing burglar as the locker 56 locks with the window frame 10 automatically when the window panel is fully closed, so that no other locking device is required. And, during the window is opened/closed, power can be supplied to the motors M continuously by the power supply contact members 54 at an elastic contact with the power supply metal terminals, and there is no danger of receiving an electric shock since the power supply metal terminals 40 are fitted to the upper portion of the window frame to which hands of children can reach with difficulty.

In the meantime, a case when the window is opened/closed, not by remotely, but by hand.

Figure 9:
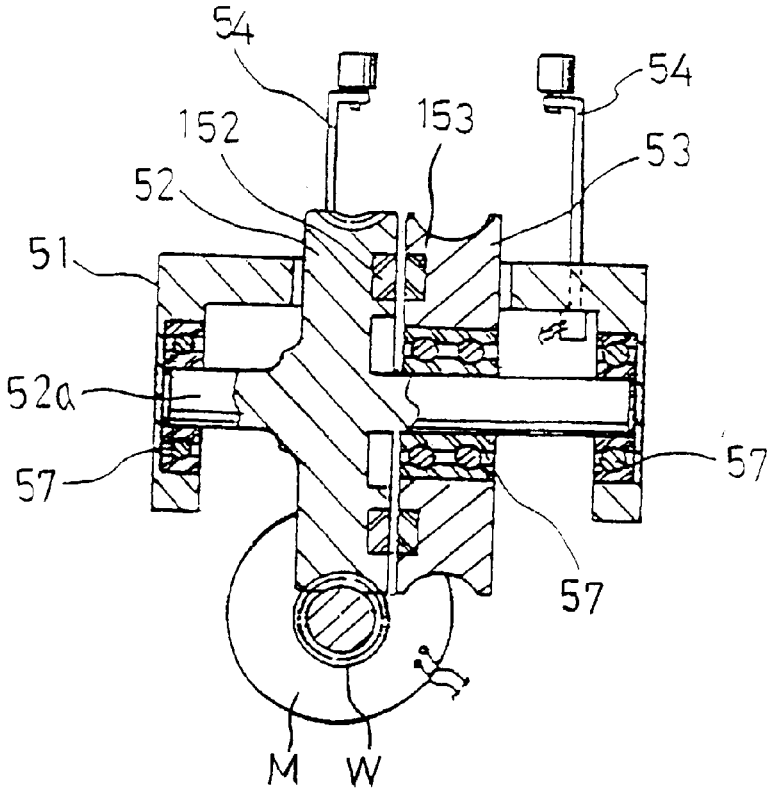
FIG. 9 illustrates a section of window moving means in accordance with a second preferred embodiment of the present invention.

When it is intended to open the window in a state the window is closed fully, manual release of the locker 56 locked in the opening 10 in the window frame 10 is required, for which the handle 94(see FIG. 6) at one side of the window panel 30 is pulled, to rotate the actuating bar 92 in a clockwise direction centered on the hinge 91, to release a free end of the locker 56 from a locking hole 2 in the window panel 30. After the locker 56 is released from the opening 2 in the window panel 30, the window panel 30 may be pushed with a force, the roller 53 is rotated to open the window panel 30 even if the roller 53 is brought into contact with the worm gear 52 forced by the spring 53*a*, if the force pushing the window is greater than force of the spring 53*a*. In a case when a structure as shown in FIG. 3 is used, though there is noise occurred in opening/closing the window by hand caused by friction between the worm gear 52 and the roller 53, there is no problem in opening/closing the window, which is not taken into consideration in the first embodiment. However, a second embodiment of the present invention has a structure as shown in FIG. 9 for complete elimination of such a friction noise. That is, when it is intended to open the window by hand, at which the motor is not driven and the worm gear 52 is not rotated, if the window panel is pushed with a force greater than the first and second permanent magnets 152 and 153, which are spaced a distance apart, the roller 53 rotates, to open the window without noise as the first and second magnets 152 and 153 are spaced a distance apart.

Figure 8:
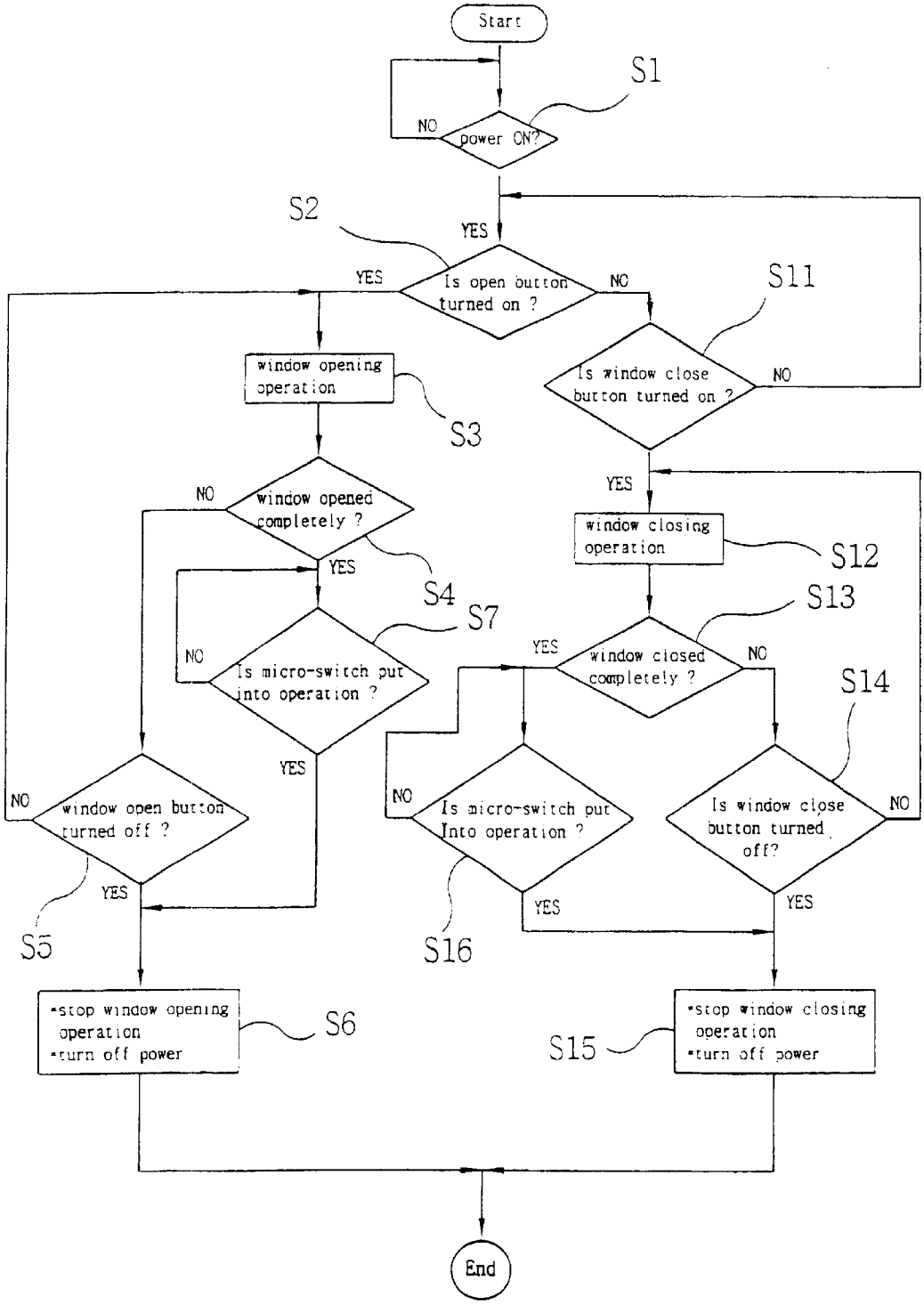
FIG. 8 illustrates a control flow chart for remote opening/closing one side of window of the balcony shown in FIG. 1.

FIG. 8 illustrates a flow chart of the controller 73 for opening/closing a window, referring to which a flow of control will be explained.

First, when it is intended to open the window in a state the window is closed, when the user presses the power switch (ON/OFF) on the remote controller 60, the program proceeds from step S1 to step S2, when the controller 73 determines the next signal of being a window open signal. If the next signal is the window open signal, the controller 73 controls the power device 74 and the motor driver 75, to supply power to the motors M1 and M2(herein, the M1 and M2 refer to the motors fitted to left and right sides of the window panel 30 in FIG. 1 for convenience of identification) to open the window and to provide power to the solenoid coils(reference numerals are omitted) on the lockers 56, so that the lockers 56 are unlocked from the locking holes 2 in the window frame 10, automatically.(Step S3). In such as window panel 30 opening, the controller 73 determines complete opening of the window panel 30, to proceed from step S4 to S5 when the window panel 30 is not opened completely, and to proceed from step S5 to step S3 when the open button is not turned off, to carry out the window panel opening, continuously. If the window open button ◀ being pressed by the user is released during the window panel opening, the power to the motors M1 and M2 are cut off, to stop the motors M1 and M2, to stop the window panel 30 opening, too.(Step S6). However, when the window is opened fully in the window panel 30 opening, the program proceeds from step S4 to S7, to wait for operation of the switch 80. When the switch 80 is put into operation, the controller 73 cuts off the power to the motors M1 and M2, to proceed from step S7 to step S6 to stop operation of the motors M1 and M2.

On the other hand, if the received signal is a window close signal as a result of determination in the step S2, the controller 73 proceeds the program from step S2 to step S11, to control the power device 74 and the motor driver 75, to supply power to the motors M1 and M2, to reverse the motors for closing the window panel 30. (Step 512). In the window panel 30 closing, the controller 73 determines the window of being closed completely, and proceeds the program from step S13 to S14 if the window is not closed fully, and, proceeds the program from step S14 to step S12, to continue the window panel closing, if the window close button is not turned off. If the window close button ▶ being pressed by the user is released during the window panel closing, the power to the motors M1 and M2 are cut off, to stop the motors M1 and M2 and to stop the window panel closing. (Step S15). However, if the window panel 30 is closed fully in the window panel closing, the program proceeds from step S13 to step S16 to wait for operation of the switch 80. When the switch 80 is put into operation, the controller cuts off the power to the motors M1 and M2, to proceed the program from step S16 to step S15 to stop the motors. Thus, the remote controllable device for automatic opening/closing of a window in accordance with a first preferred embodiment of the present invention permits to open/close window remotely by using the window open/close button on a remote controller, to open/close to a desired, extent by releasing the window open/close button being pressed by the user since the window is only opened/closed while the window open/close button is pressed, to prevent the motors from being overloaded because the power is cut off automatically when the window is opened/closed fully, and to carry out anti-burglar function as no additional locking device is required because the lockers are locked into the window frame when the window is closed fully.

FIG. 9 illustrates a second embodiment of the present invention, wherein parts identical to the first embodiment will be given the same reference numerals, and detailed explanations of which will be omitted in explaining the second embodiment of the present invention.

Referring to FIG. 9, a system for minimizing the friction between the worm gear 52 and the roller 53 during the manual opening/closing of window is shown, wherein a first permanent magnet 152 is fitted to one side of the worm gear 52 engaged with the worm W mounted on the rotation shaft MS of each of the motors M, and a second permanent magnet 153 is fitted to one side of the roller 53 facing the first permanent magnet 152 for exerting a magnetic force to the first permanent magnet 152 to make a contactless rotation between the roller 53 and the worm gear 52, with a gap between the first and second magnets maintained. In other word, when the worm gear 52 is rotated, the roller 53 is made to rotate by the magnetic forces between the first and second permanent magnets 152 and 153. Accordingly, when it is intended to open the window by hand, even if the worm gear 52 is not put into rotation by putting the motors into operation, the roller 53 can be rotated 53 if the window panel is pushed with a force greater than a magnetic force caused by the first and second permanent magnets 152 and 153 as the first and second magnets 152 and 153 are spaced a distance apart without noise because, different from the system shown in FIG. 3, the first and second magnets 152 and 153 are disposed with a gap. The second embodiment of the present invention has advantage in that no noise is generated in manual opening/closing of the window panel 30.

Figure 10:
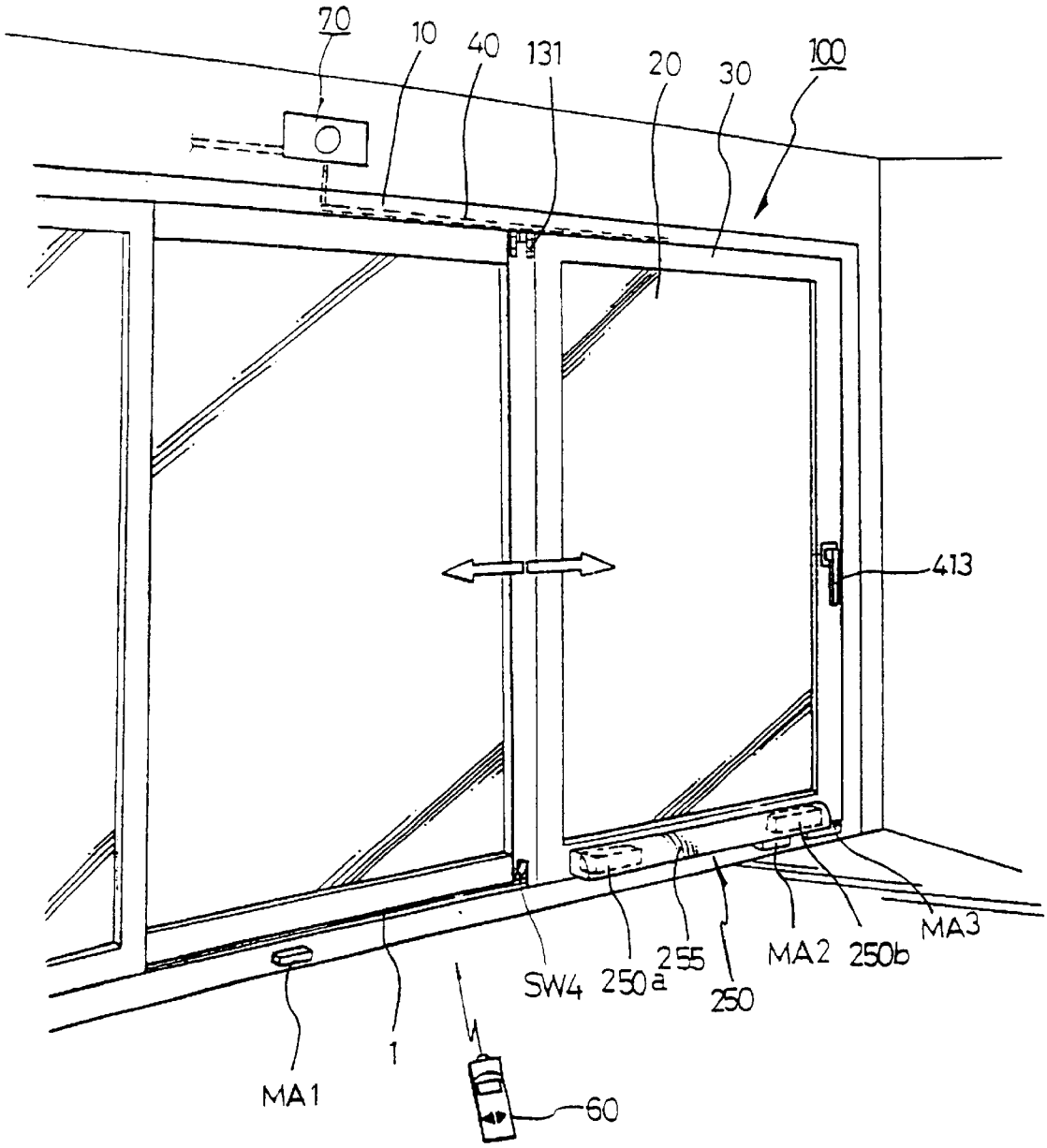
FIG. 10 illustrates a front view of a balcony window having remote controllable device for automatic opening/closing of a window in accordance with a third preferred embodiment of the present invention applied thereto, for showing opening/closing state of the window, schematically.

FIGS. 10 to 18 illustrate a device for automatic opening/closing a window in accordance with a third preferred embodiment of the present invention, which is a modification from the first embodiment. In other word, even though the window is being opened/closed during the remote controller is being pressed, as the power is supplied to the motors, in the window panel opening/closing according to the first preferred embodiment, because the power to the motors is cut off only when the window is opened/closed fully at which the micro-switch 80 comes into operation, the accelerated window panel 30 may hit the window frame 10 strongly, to give an impact to the window panel 30, that may reduce a lifetime of the device. And, since the first embodiment device has the window moving means built-in the upper frame of the window panel 30, in cases when the motor or the like is broken, the large and heavy window panel 30 should be taken away from the window frame 10 completely, which requires two men and much time, and is cumbersome and costly. Moreover, the first embodiment device may cause excessive friction noise in opening/closing the window as the roller is brought into contact with the worm gear compressed by the spring to rotate with the worm gear. Accordingly, the third embodiment is modified version of the first embodiment for improving the drawback of the first embodiment, which will be explained with reference to FIG. 10. FIG. 10 illustrates a window 100 having the remote controllable device for automatic opening/closing of a window in accordance with a third preferred embodiment of the present invention applied thereto schematically, wherein parts identical with the first embodiment in FIG. 1 will be given the same reference numerals, and detailed explanation of which will be omitted.

Figure 11:
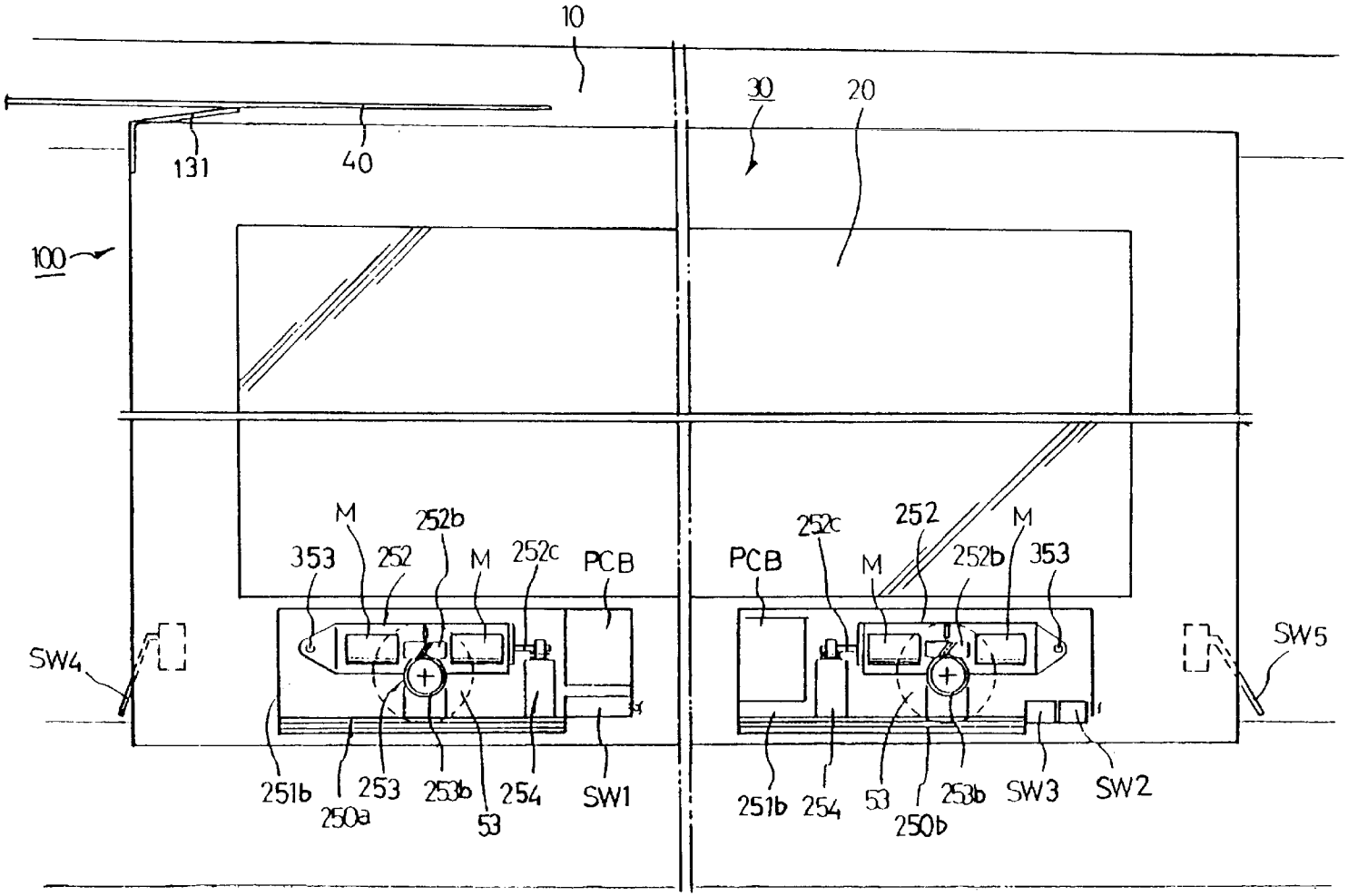
FIG. 11 illustrates a front view of a window showing the window moving means in FIG. 10 fitted thereto, schematically.

Referring to FIGS. 10 and 11, in the third embodiment of the present intention, window moving means 250 is detachably fitted to a lower portion of outside of the window panel 30 either for remote automatic opening/closing of the window panel 30 by using the remote controller 60, or for opening/closing of the window panel 30 by hand. As shown in FIG. 10, there is a metal terminal 40 fitted along an inside wall of the window frame 10 for supplying power, which is always in contact with an electric contact 131 fitted to the window 30 for supplying a DC voltage (for example, 12–30V) to the window moving means 250 and the like even if the window panel 30 is moved in a horizontal direction. For this, though not shown in FIG. 10, it is assumed that there are lines laid in the window panel 30 from the electric contact 131 to electric components which require power, such as solenoids. In FIG. 10, though it is shown that the window moving means 250 of the present invention is fitted to a lower portion of outside of the window panel 30(the word outside means an exterior of a piece of a window panel frame, which is a living room side from which the user operates the window by using the remote controller), it is only exemplary, and not necessarily limits the present invention. For example, the window moving means 250 may be fitted to an upper portion of an outside of the window panel 30. However, in order to help understanding this specification of the present invention, and considering convenience of repairing the window moving means 250 fitted to the window panel 30 heavy with the window pane 20, it is assumed that the window moving means 250 is fitted to the lower portion of the window panel 30 as shown in FIG. 10. As shown in FIGS. 10 and 11, the window moving means 250 is detachably fitted to an outside of the window panel 30 for receiving power from the power supply terminal 40, and rotating the roller 53 guided along the rail 1 on the window frame 10 to move the window panel in a horizontal direction with rail 1.

The window moving means 250 includes first and second window moving means 250*a* and 250*b* detachably fitted to a lower portion of an outside of the window panel 30 at an opened side and a closed side thereof, respectively.

Although the first and second window moving means 250*a* and 250*b* are shown detachably fitted to the lower portion of the outside of the window panel 30 at the opened side(a left side in FIGS. 10 and 11) and the closed side(a right side in FIGS. 10 and 11) thereof respectively, this is only exemplary, and does not limit the present invention. For example, only one of the first and second window moving means 250*a* and 250*b* may be fitted to a central lower portion of the outside of the window panel 30, and the rollers 53 are fitted to the lower portion of left and right sides of the window panel 30 respectively, or only one of the first and second window moving means 250*a* and 250*b* may be fitted to the lower portion of the left or right side of the outside of the window panel 30, and the roller 53 is only fitted to the lower portion of the rest of the left of right sides of the window panel 30. However, considering the window panel 30 is very heavy, for easy repair in a case when the window moving means is not in order, and for smooth horizontal movement of the very heavy window panel 30, it is preferable that both of the first and second window moving means 250*a* and 250*b* are provided.

Figure 12:
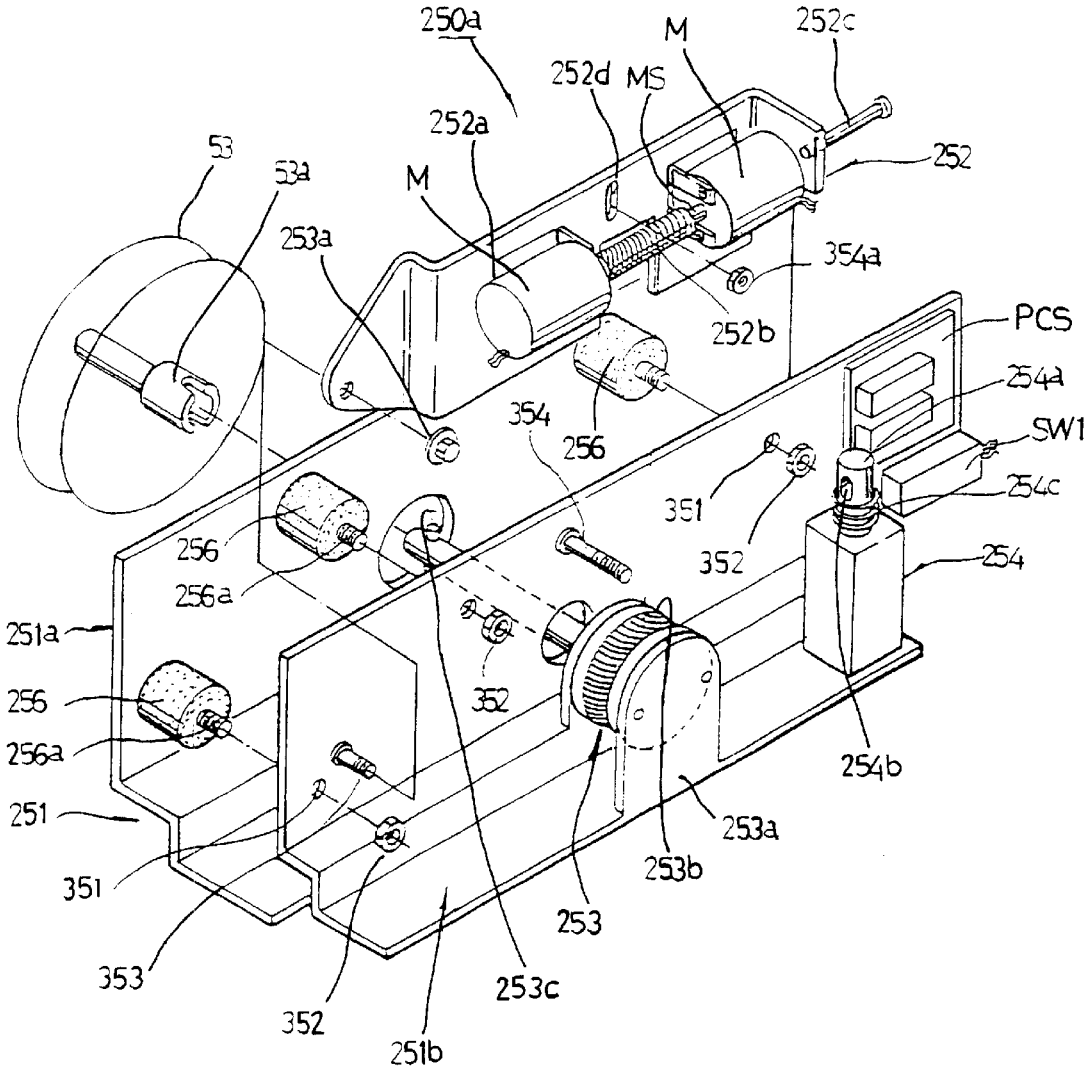
FIG. 12 illustrates a perspective disassembled view of the window moving means in FIG. 10, with a cover thereof removed.

FIG. 12 illustrates a perspective disassembled view of the first window moving means 250*a*. Since, as can be known from FIG. 11, the first window moving means 250*a* is identical to the second window moving means 250*b* with respect to technical point except the arrangement of components therein differ, only the first window moving means 250*a* will be explained.

Figure 15:
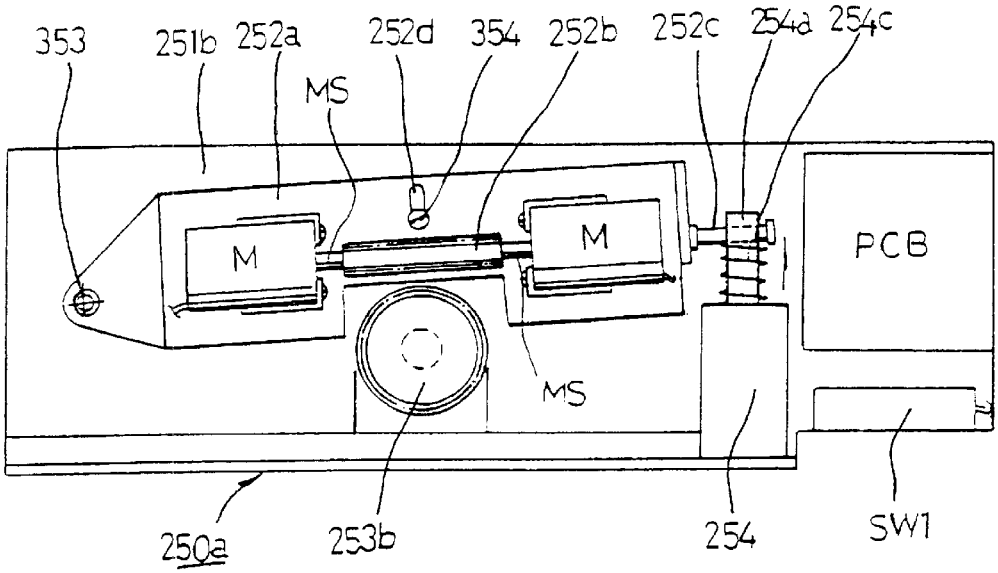
FIG. 15 illustrates a front view of the window moving means in FIG. 12 for showing a stationary state thereof.

Referring to FIG. 12, the first window moving means 250*a* includes a base member 251 detachably fitted to an outside of the window panel 30, inclusive of a first base plate 251*a* fitted to the outside of the window panel 30 directly, and a second base plate 251*b* spaced a distance from the first base plate 251*a*. And, there are a plurality of attenuating members 256 between the first and second base plates 251*a* and 251*b* for attenuating impact transmitted to the second base plate 251*b* in opening/closing the window panel 30. The attenuating member 256 is preferably formed of a highly elastic material(for example, a hard rubber, or something corresponding to it), through which a threaded shaft 256*a* fixed to a central portion of the first base plate 251*a* is inserted. An opening 351 in the second base plate 251*b* is inserted to the threaded shaft 256*a*, and a nut 352 is fastened to the threaded shaft 256*a*, to assemble the first and second base plates 251*a* and 251*b*, together. As shown in FIG. 15, there is rotating force generating means 252 in the second base plate 251*b* for generating a rotating force when the window panel 30 is automatically opened/closed, which has the other end rotatable centered on a hinge 353.

Figure 14:
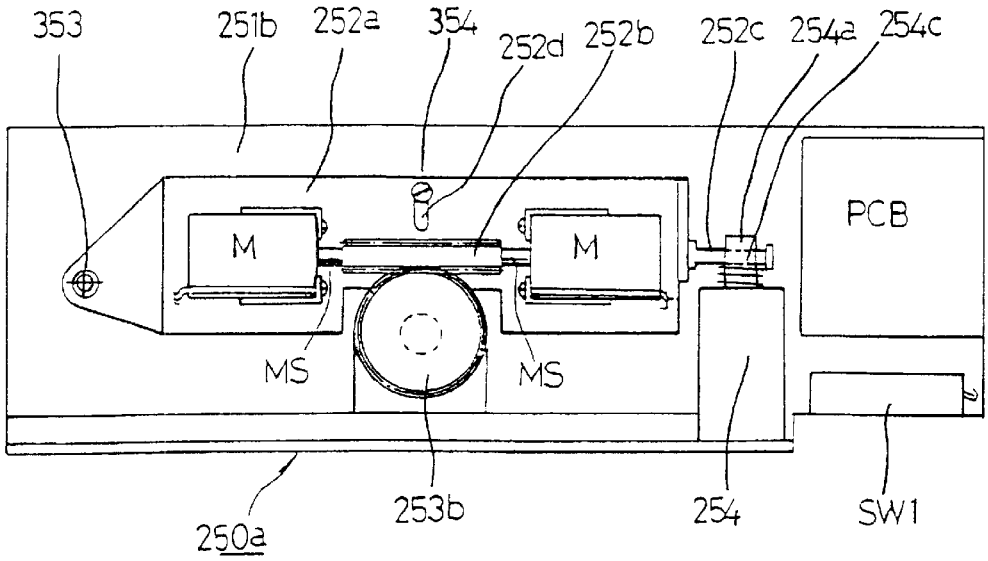
FIG. 14 illustrates a front view of the window moving means in FIG. 12 for showing an operation state thereof.

Referring to FIG. 12 again, the rotating force generating means 252 includes a holder 252*a* fitted to the second base plate 251*b* of the base member 251 having the other end rotatable centered on the hinge 353, and two motors M rotatable in a regular or reverse direction for generating a rotating force in automatic opening/closing the window panel 30. There is a worm 252*b* mounted on a rotating shaft MS of each of the motors M. The holder 252*a* is inserted in the hinge 353, and a nut 253*a* is fastened thereto. As shown, the motors M are fitted to face each other with the worm 252*b* positioned in between, for exerting strong powers and operating one motor if the other motor is out of order in opening/closing the window panel 30. It is preferable that the motors are rotated in opposite directions as the motors are fitted oppositely. And, there is an elevating rod 252*c* for rotating the holder 252*a* centered on the hinge 353 by means of the elevating means 254 as shown in FIGS. 14 and 15.

In the meantime, as the rotating force generated by the rotating force generating means 252 is transmitted to the roller 53 through a roller rotating means 253, the roller 53 is rotated to open/close the window panel in a horizontal direction, wherein the roller rotating means 253 includes a worm gear 253*b* rotatably fitted to a bracket 253*a* on the second base plate 251*b*, and a rotating shaft 253*c* fitted to the worm gear 253*a* for rotating the roller 53. It is preferable that there is a pin 253*d* inserted in a shaft 53*a* of the roller 53 in the vicinity of an end of the rotating shaft 253*c* for efficient transmission of a rotating force of the worm gear 253*b* to the roller 53. Forms of these pin 253*b* and the roller shaft 53*a* may be replaced with other forms(for example, square form).

The elevating means 254 is fitted to the second base plate 251*b*, preferably of a solenoid, with an elevating rod inserted to a through hole 254*b* in an actuator bar 254*a* of the solenoid. According to this, during automatic opening/closing of the window panel 30, the solenoid 254 makes the worm 252*b* in the rotating force generating means 252 to engage with the worm gear 253*b* in the roller rotating means 253, so that the rotating force from the motors M is transmitted to the worm gear 253*b* through the worm 252*b*, and, during stop of automatic opening/closing of the window panel 30 and manual opening, the solenoid 254 makes the worm 252*b* to be disengaged from the worm gear 253*b*, so that the rotating force from the motors M is not transmitted to the worm gear 253*b*. Eventually, the solenoid 254 comes into operation during the automatic opening/closing of the window panel 30 only, so that the worm 252*b* and the worm gear 253*b* come into engagement as shown in FIG. 5, to open/close the window panel 30 in an automatic mode (remote control mode), and the solenoid does not come into operation during the manual opening of the window panel 30, so that the worm 252*b* and the worm gear 253*b* are disengaged from each other as shown in FIG. 15, to permit free opening/closing of the window panel 30, without any noise.

Figure 17:
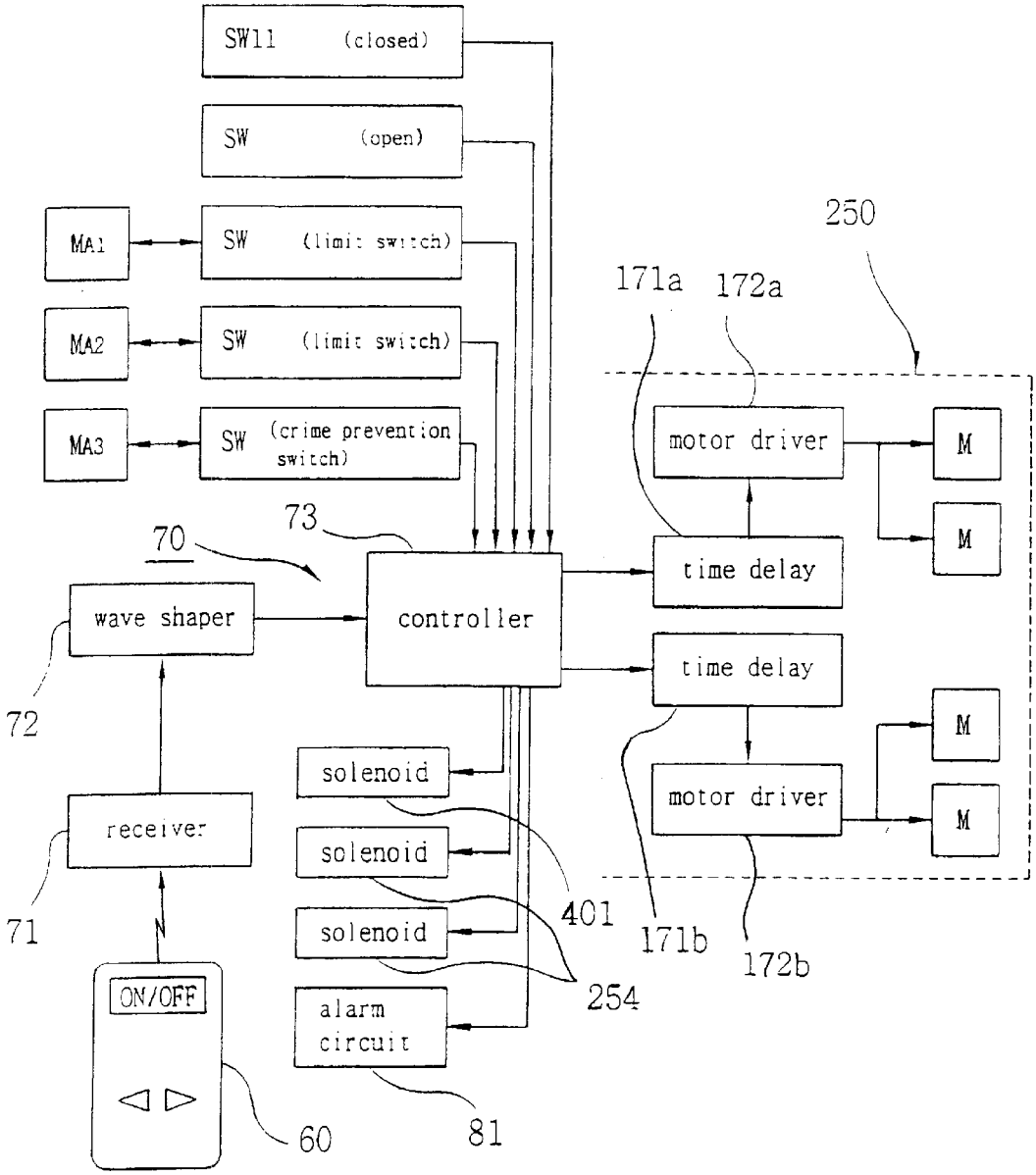
FIG. 17 illustrates a block diagram of a system for remote, automatic control of a window in accordance with a third preferred embodiment of the present invention.

FIG. 17 illustrates a block diagram of a control means 70 used in the present invention schematically, includes delay circuits 171*a* and 171*b* which are provided for putting the solenoid 54 into operation at first in an initial automatic opening/closing of the window panel 30 to make the worm 252*b* in the rotating force generating means 252 to come into engagement with the worm gear 253*b*, roller rotating means 253, before a preset time period when the motors M in the rotating force generating means 252 are put into operation to generate the rotating force. The delay circuits 171*a* and 171*b* may have time constant devices, such as resistors and condensers(not shown).

The present invention includes window movement deceleration means inclusive of lead switches sw11 and sw12 fitted to the window moving means 250*a* and 250*b*, and magnets MA1 and MA2 fitted to the window frame 10 as shown in FIGS. 10 and 12 for decelerating movement of the window panel 30 when the window panel 30 comes close to full open or closure during automatic opening/closing of the window panel 30, to prevent the window panel 30 from being given an excessive impact. Therefore, when the window panel 30 is opened by means of the transmitter 60, operation of the motors M and solenoid are controlled by a signal sensed by the lead switch sw11 in the window moving means 250*a* fitted to the open side of the window panel, and, when the window panel 30 is closed by means of the transmitter 60, operation of the motors M and solenoid are controlled by a signal sensed by the lead switch sw12 in the window moving means 250*b* fitted to the close side of the window panel, which will be explained in detail.

And, the present invention provides anti-burglar means which gives a preset alarm signal when the window panel 30 is forced open from outside of the room in a state the window panel is closed completely, inclusive of, as shown in FIGS. 10, 11, and 17, an anti-burglar lead switch sw13 fitted at a lower portion of the window panel 30 for sensing opening of the window panel 30, an anti-burglar magnet MA3 fitted to the window frame 10 opposite to the lead switch sw13, and an alarm circuit 81 at an appropriate position of the window panel 30 for giving an alarm signal at operation of the anti-burglar lead switch sw13. Accordingly, when a robber or burglar breaks into the house by opening the locked window panel 30 from outside of the house during night or outing, the alarm circuit comes into operation for the user to know someone has broken into the house. The signal for informing the opened window panel 30 may be, for example, a visible signal by using a light, or a visible and audible signal, such as a police light, or an additional anti-burglar device may be connected to the alarm circuit 81, to use an emergency telephone number to inform the house breakage to a neighbor, police or a guard station.

In the meantime, in order to stop the window moving means 250 automatically when the window panel 30 is opened or closed fully for preventing waste of the energy, and, as explained later, in order to prevent the motors from being overloaded as the user keeps pressing down the open or close button of the remote controller even if the window panel 30 is opened or closed fully, the window panel 30 is fitted with switches sw14 and sw15.

Figure 16:
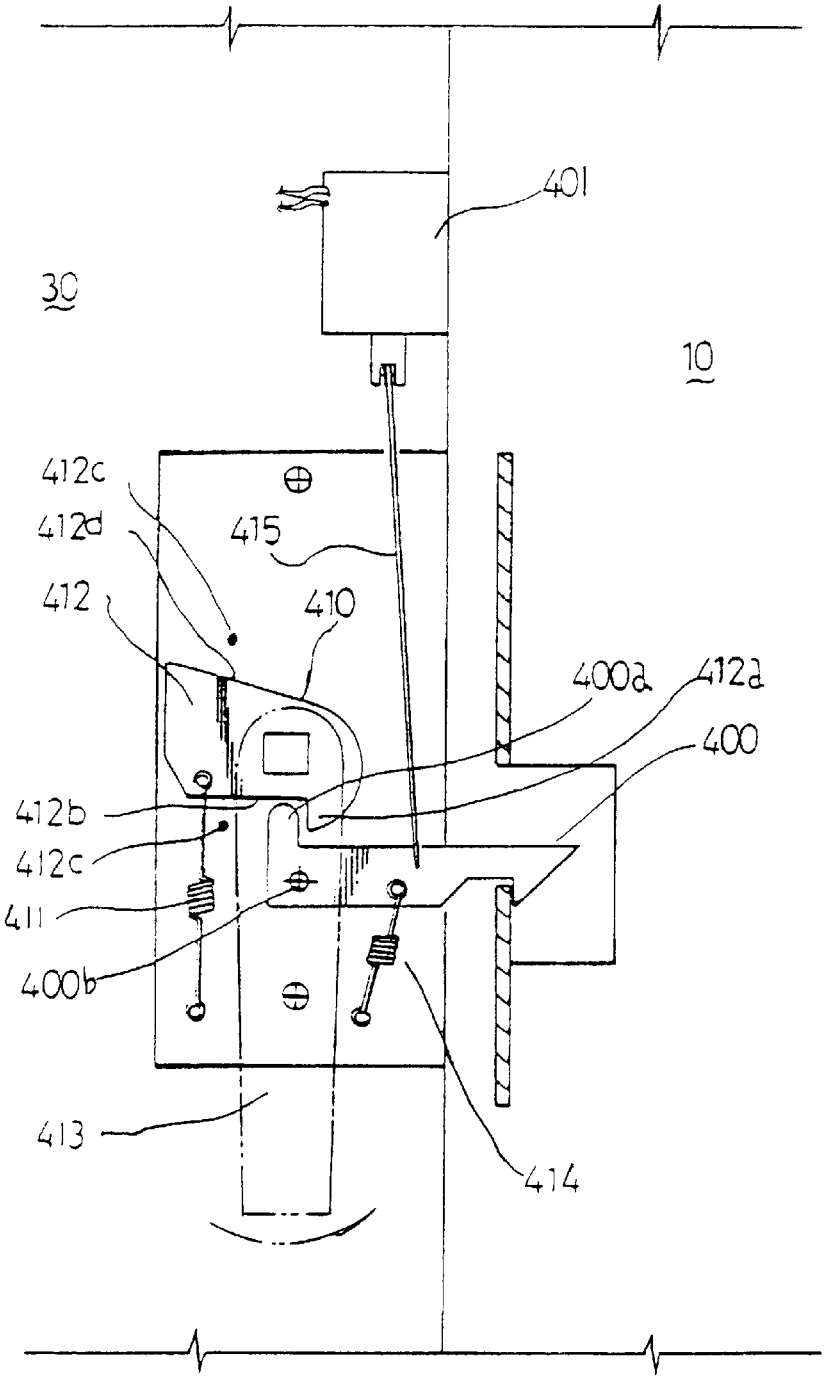
FIG. 16 illustrates a frontal partial cut away view of a window and a window frame for showing unlocking and locking states of a locker when a manual or automatic opening of the window is required in the remote controllable device for automatic opening/closing of a window in accordance with a third preferred embodiment of the present invention.

And, as shown in FIG. 16, a locker 400 is provided to lock into the window frame 10 for preventing opening of the window panel 30 when the window panel 30 is closed fully, which locker 400 is preferably operative in electromagnetically by a solenoid 401. It is preferable that the locking to the window frame 10 is released automatically as the solenoid 401 is operated when the remote controller 60 is pressed(when it is intended to open the window).

Locker releasing means 410 is shown in FIG. 16, for manual releasing of the locker 400 in a case of manual opening of the closed window panel 30, including a rotating means 412 elastically rotatable by a spring 411 and interlocked with a handle 413 for gripping, rotating and pulling by hand when the window panel 30 is opened/closed by hand. As an upper surface and a lower surface 412*d* and 412*b* of the rotating member 412 are made to be barred by the stoppers 412*c* on upper and lower sides thereof when the window panel 30 is closed and opened, permitting no more rotation of the handle 413, the user may open/close the window panel 30 with easy by gripping the handle 413. And, the locker 400 has a spring 414 connected thereto for locking the locker 400 into the window frame 10 when the handle 413 comes to a position shown in two dotted chain line, and the solenoid 401 and the locker 400 are connected to each other by an operating bar 415.

Referring to FIG. 12 again, there is a limit bar 354 for limiting a moving range of the holder 252*a*, inserted in a guide hole 252*d* in the holder 252*a* and fastened by a nut 354*a*, such that the limit bar 354 is caught at an upper portion of the guide hole 252*d* when the rotating force generating means 252 is engaged with the roller rotating means 253 as shown in FIG. 14, and the limit bar 354 is caught at a lower portion of the guide hole 252*d* when the rotating force generating means 252 is disengaged from the roller rotating means 253 as shown in FIG. 15, for preventing the holder 252*a* from being pushed upward by an elastic force of the spring 254*c* when the solenoid is turned off. The reference symbol PCB on a right portion of the second base plate 251*b* denotes a printed circuit board having electric, and electronic circuits mounted thereon for controlling the motors M, solenoids 254, and various switches.

Figure 13:
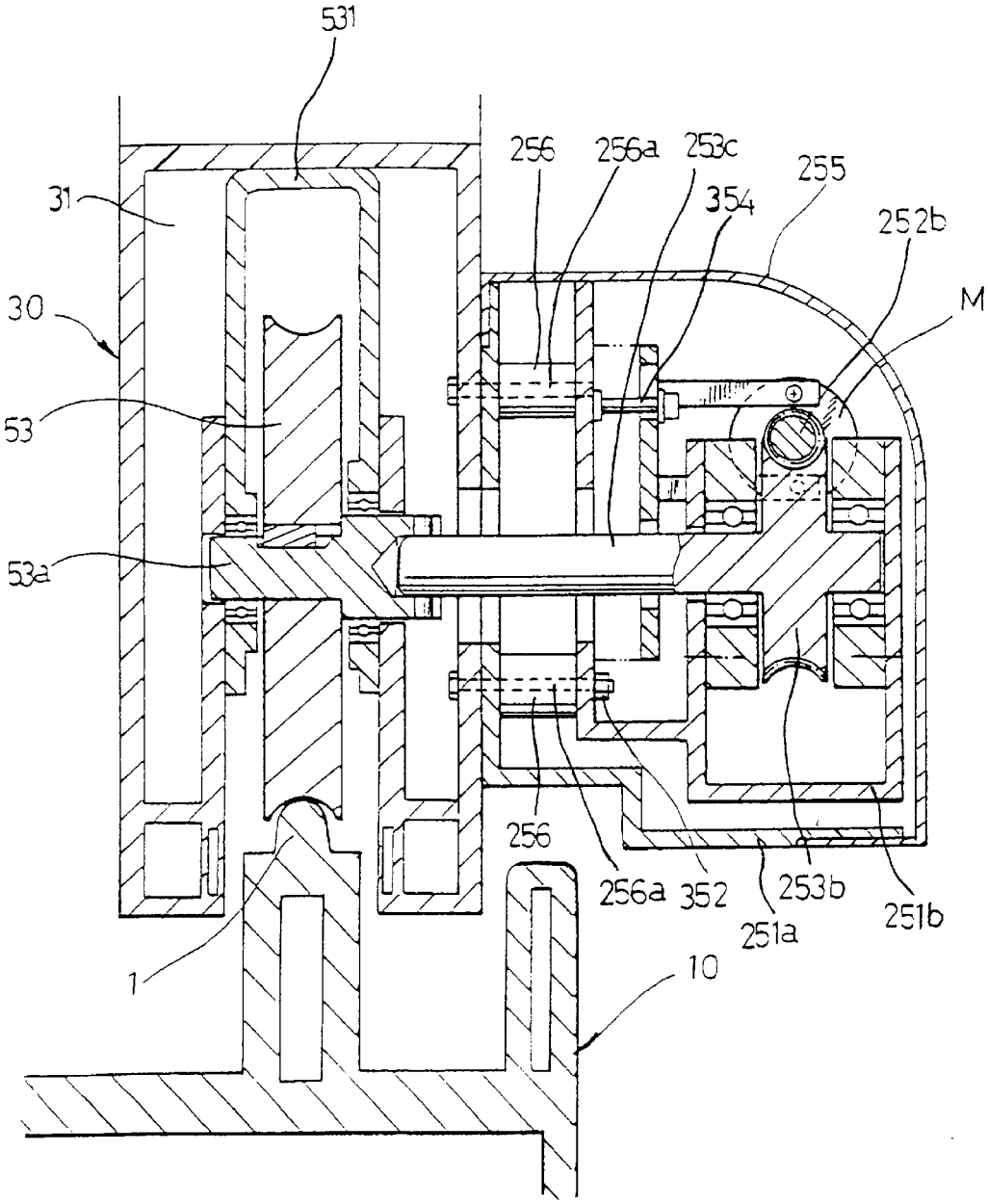
FIG. 13 illustrates an enlarged, assembled, and sectional view of the window moving means in FIG. 12.

Referring to FIG. 13, the roller 53 is fitted in a frame member of the window panel 30 by a generally known method, wherein a roller holder 531 is fitted in the frame member of the window panel by an appropriate method(for example, screw fastening), a bearing (reference symbol is omitted) is fitted to a part of the roller holder 531 a rotating shaft 53*a* of the roller 53 is inserted therein for smooth rotation of the rotating shaft 53*a* rotated together with the roller 53, and the roller 53 is fixed to the shaft 53*a* by key and groove coupling(reference symbols are omitted) which is well known.

FIG. 17 illustrates a block diagram for remote control of a window panel 30, wherein a power signal from the transmitter 60, and window open or/and window close control signal are provided to the signal receiver 71 in the control means 70, signals required for control are wave shaped at the wave shaper 72 before the signals are provided to the controller 73, and the controller 73 receives and determines the control signals, and controls various devices to which the power device(not shown) generating, for example, 12–30V, supplies power, of which most important thing is that the motor drivers 172*a* and 172*b* are driven through the delay circuits 172*a* and 172*b*, respectively. In other word, when the user opens or closes the window panel by using the remote controller 60, if the solenoid 254 and the motor M are put into operation on the same time, since respective gear teeth may be damaged when the worm 252*b* and the worm gear 253*b* are engaged, and a noise following the damage may occur, an operation timing of the motor is delayed a little than the solenoid 254, for preventing such a damage.

The operation of the aforementioned third embodiment will be explained.

When it is intended to open the window panel 30 in a direction shown in solid line in FIG. 10 from a state the window panel 30 is closed, if the user presses the power switch(ON/OFF) on the remote controller 60, the controller 73 shown in FIG. 17 puts the solenoid 254 and the solenoid 401(see FIG. 16) into operation on the same time, at which the solenoid 254 is changed from a state of FIG. 15 to a state of FIG. 14, and the solenoid is operated to release the locker 400. Thus, as the locker 400 is released and the solenoid comes into operation, the holder 252*a* in the rotating force generating means 252 moves down toward the roller rotating means 253, to make the worm 252*b* to engage with the worm gear 252*b*. In this instance, the motor drivers 171*a* and 172*b* have not come into operation yet as the delay circuits 171*a* and 171*b* are in operation. Under this state, if the user keeps pressing the window open button ◀ on the remote controller 60, the motors M start to rotate in a regular direction after a preset time period is passed(i.e., after the engagement of the worm 252*b* and the worm gear 253*b* is completed), when the worm gear 253*b* in engagement with the worm 252*b* is rotated, together with the roller 53 fixed to the shaft 53*a*, as the worm 252*b* on the rotating shaft MS of the motors M is rotated, to move the window panel 30 in a direction shown in an arrow represented with a solid line in FIG. 10. If the pressed window open button ◀ is released in the middle of such a movement, to cut off the power to the motors M and the solenoids 254, the motors M stop and the solenoids 254 are actuated as shown in FIG. 15 again, to disengage the worm 252*b* from the worm gear 253*b*, to stop the opening action of the window panel 30.

However, if the motors M are kept to be operative, to open the window panel 30 continuously, at a time the lead switch sw11(see FIG. 11) in the first window moving means 250*a* of the window moving means 250 passes the magnet MA1 fitted to the window frame 10, the lead switch sw11 is turned off automatically, to provide a signal to the controller 73 in FIG. 17, when the motors M are disabled and, on the same time, the solenoids 254 are turned off, to stop the operation, instantly. As described, if the motors M and the solenoids 254 are put into operation again from a stationary state, because the worm 252*b* and the worm gear 253*b* come into operation by the motors M after a preset delay time period is passed, the present invention provides a method to decelerate a moving speed of the window panel 30 by using the lead switch sw11 and the magnet MA1. Therefore, if the lead switch sw11 is turned on after the lead switch sw11 is turned off momentarily by the magnet MA1 during the window is opening, after the moving speed of the window panel 30 is reduced as much as the delay time period caused by the delay circuits, the window panel 30 can be kept opening, continuously. When the window panel is opened completely in opening the window, the micro-switch sw14 is actuated, when the controller 73 stops the motor drivers 172*a* and the 172*b* as well as the solenoids 254, to prevent the motors M form being overloaded.

In the meantime, if it is intended to close the window from a state the window panel 30 is opened completely, provided the user keeps pressing the window close button ▶ after the user presses the power switch ON/OFF, identical to the foregoing description, the motors M rotate in a reverse direction after a preset time period is passed since the solenoids 254 are actuated, to close the window panel 30. If the pressed window close button ▶ is released in the middle of the such a movement, the power to the motors M and the solenoids 254 is cut off, to stop the motors M, and to move the solenoids 254 as shown in FIG. 15 again, to stop the window panel 30 closing as the worm 252*b* is disengaged from the worm gear 253*b*. However, if the motors M are kept operative to keep the window panel 30 closing, at a time the lead switch SW12(see FIG. 11) in the first window moving means 250*b* of the window moving means 250 passes the magnet MA2 fitted to the window frame 10, the lead switch sw12 is turned off automatically, to provide a signal to the controller 73 shown in FIG. 17, when the motors M are disabled and the solenoids 254 are turned off, to stop the operation, instantly. Therefore, if the lead switch sw12 is turned on again after the lead switch SW12 is turned off by the magnet MA2 momentarily in closing the window, after the moving speed of the window panel 30 is reduced as much as the delay time period caused by the delay circuits, the window panel 30 can be kept closing. When the window panel comes to a complete closing in the closing operation, the micro-switch sw15 comes into operation when the controller 73 stops the operation both of the motor drivers 172*a* and 172*b* and the solenoids 254, to prevent the motors M from being overloaded, and causes the locker 400 shown in FIG. 7 to be locked into the window frame 10.

When the window panel 30 is forcibly opened from outside of the room during night or outing in a state the window panel 30 is thus closed completely, the ant-burglar lead switch sw13 fitted to the second window moving means 250*b*comes away from the anti-burglar magnet MA3, to activate the lead switch sw13, that gives a signal to the controller 73 to activate the alarm circuit 81, to inform there is someone broken into the house. Accordingly, a visible signal by a light, or visible and audible signal, such as a police light, or an emergency telephone number stored in advance may be used to inform the house breakage to a neighbor, police or a guard station by radio or line, to prevent such as burglary in advance.

In the meantime, if it is intended to open the closed window panel by hand, the handle 413 shown in FIG. 16 is rotated in a direction of arrow, to rotate the rotating member 412 fixed to the handle 413 too, when a projection 412*a* on the rotating member 412 pushes a projection 400*a* on the locker 400, to rotate a free end of the locker 400 upward centered on the rotating shaft 400*b*, that releases the locking against the window frame 10. Under this state the locker 400 is thus unlocked from the window frame 10, when the user rotates the handle 413 in the direction of arrow further, a flat part 412*b* of the rotating member 412*a* is brought into contact with the stopper 412*c*, such that the rotating member 412*a* can be rotated no more, when the handle 413 may be pulled in a clockwise direction, to open the window. This manual window panel 30 opening by using the handle 413 is made available by leaving the worm gear 253*b* to a free rotation state as the worm 252*b* and the worm gear 253*b* are disengaged as shown in FIG. 15 at the time of the solenoid 254 stop. Thus, the user may open the window panel 30 by using the handle 413 in a power off state, freely. On the other hand, when it is intended to close the window panel 30 by hand, as one side surface 412*d* of the rotating member 412 is designed to be stopped at the upper stopper 412*c*, if the handle 413 is pulled to rotate the handle 413 in a counter clockwise direction, the window panel 30 can be closed by hand.

Figure 18A:
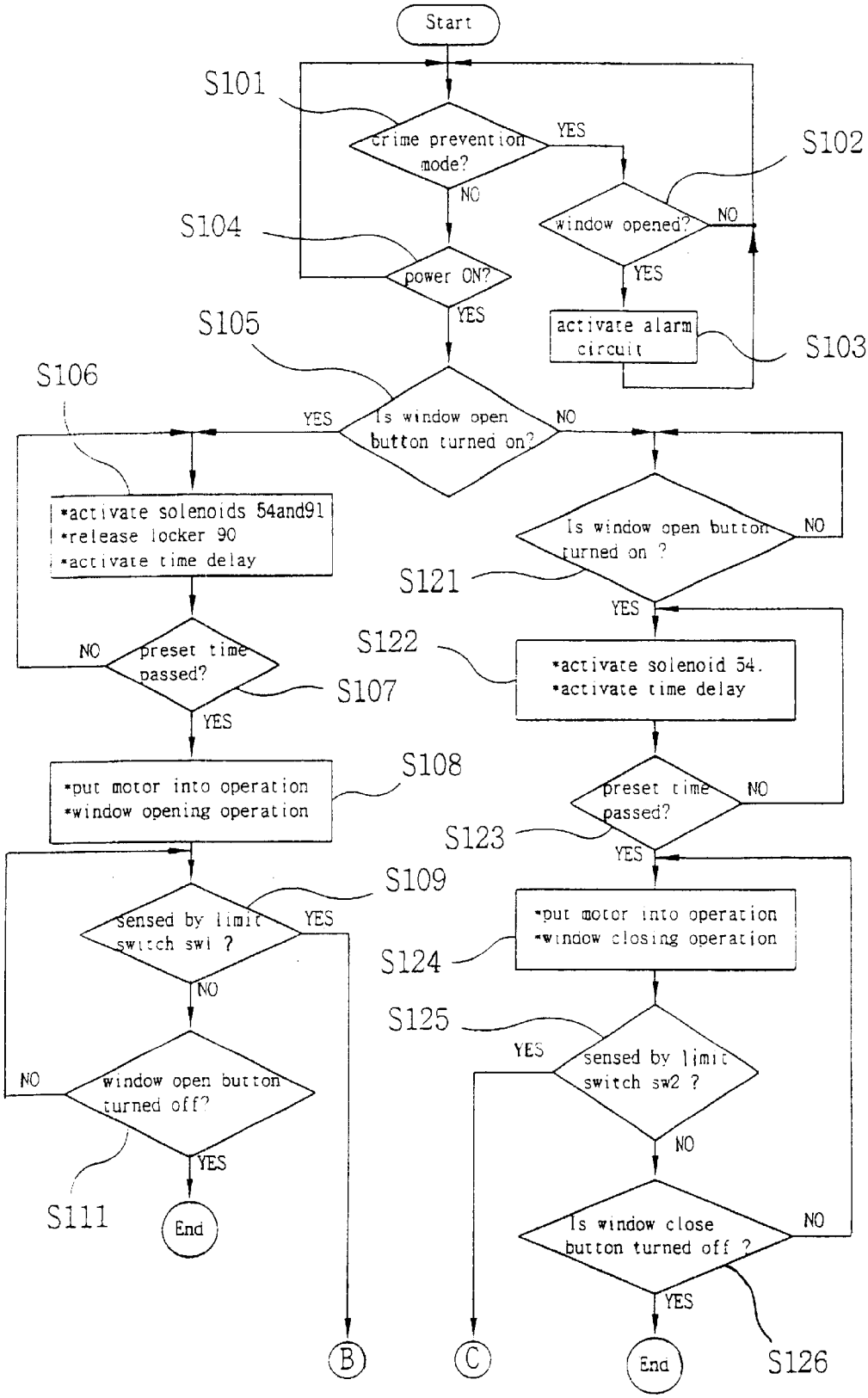
FIG. 18 illustrates a flow chart for remote control of opening/closing of the balcony window shown in FIG. 10.
Figure 18B:
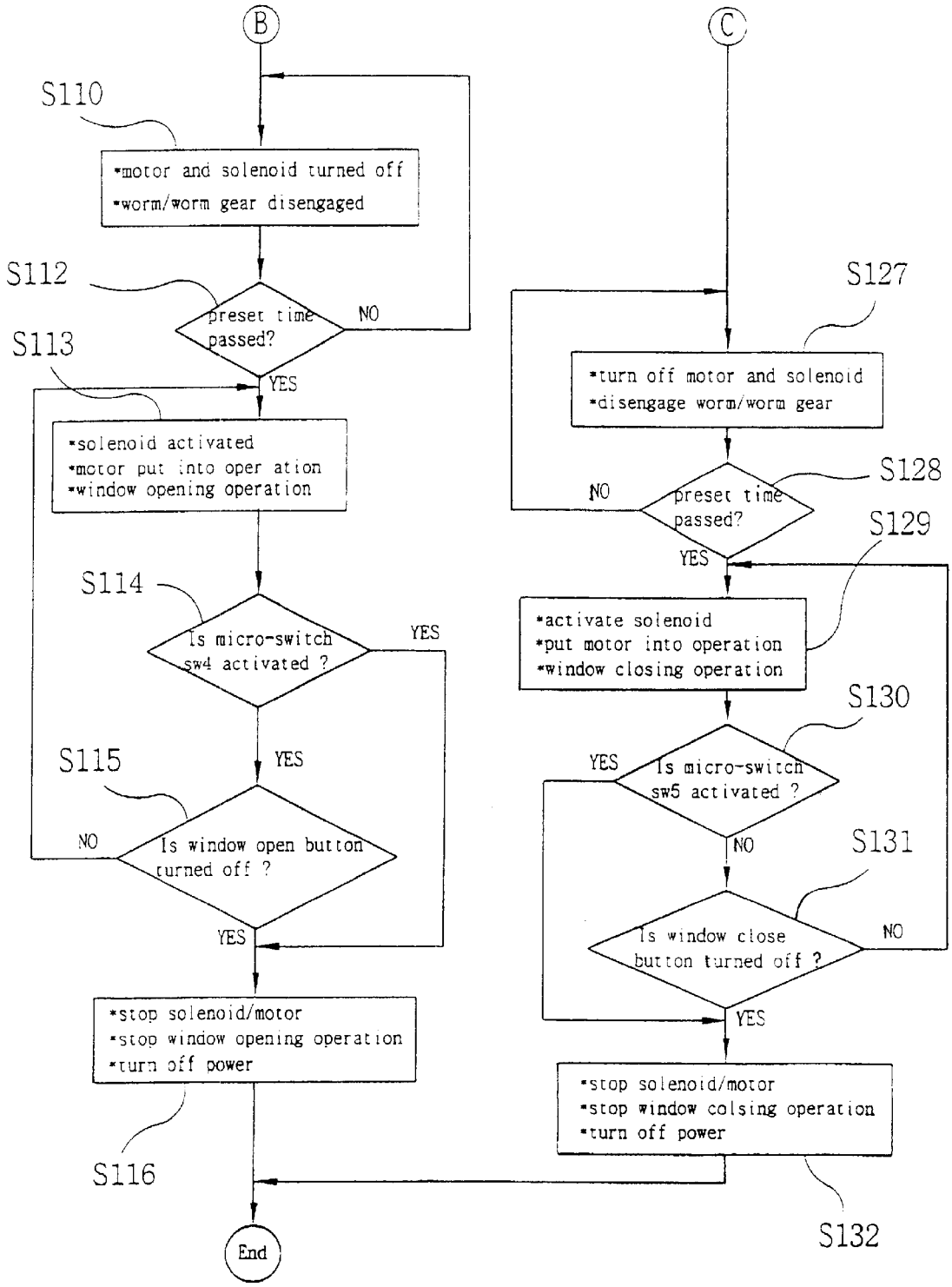

FIG. 18 illustrates a flow chart of the controller 73 for remote control of opening/closing of the window panel 30, which will be explained.

In a state the window panel 30 is closed, the anti-burglar function is in operation when the window panel 30 is forcibly opened, the program proceeds from a step S101 to a step S102, so that the controller 73 activates the alarm circuit 81 to give an alarm to outside of the house by a visible and/or audible signal in radio or line, to prevent burglary.(step S103).

In the mealtime, if it is intended to open the window panel 30 remotely by using the remote controller 60 from a state the window panel 30 is closed, when the power switch ON/OFF on the remote controller 60 is pressed, the program proceeds from a step S104 to a step S105, when the controller 73 determines the next signal being a window open signal. If the user presses the window open button < on the remote controller 60, the controller 73 activates both the solenoid 401 in FIG. 16 and the solenoid 254 in the window moving means 250, to release the locker 400 from the window frame 10, and, on the same time, to rotate the free end of the holder 252*a* in the rotating force generating means 252 centered on the hinge 353 in a clockwise direction as shown in FIG. 14, until the worm 252*b* is engaged with the worm gear 253*b*. In this instance, the controller 73 activates the delay circuits 171*a* and 172*b*, so that putting the motor M into operation is delayed until the worm 252*b* and the worm gear 253*b* are engaged fully. (Step S106). Provided that both the locker 400 is unlocked from the window frame 10 at activation of the solenoid 401, and the delay time period the solenoid activated is passed, the controller 73 starts to rotate the motors M in the window moving means 250 in a state the worm 252*b* and the worm gear 253*b* are engaged, to open the window panel 30.(Steps S107 and S108). By the way, in opening the window panel 30, the program proceed from a step S109 to a step S110 if the lead switch sw1 in the first window moving means 250*a* is activated, otherwise proceeds to a step S111, to wait for a signal from the lead switch SW1. That is, as far as the user does not release the window open button ◀ on the remote controller 60, the window panel 30 is kept opening, if the window open button ◀ is released, the program ends, to stop the motors M and to deactivate the solenoids 254, thereby stopping the window panel opening operation.

In the meantime, if the lead switch sw1 fitted to the window moving means 250*a* passes the magnet MA1 fitted to the window frame 10 during opening of the window panel 30, the lead switch sw11 is turned on after the lead switch sw11 is turned off momentarily, when the motors M and the solenoids 254 are turned on after they are turned off. However, as the motors M come into operation again later than the solenoids 254 by the delay time period, the window panel 30 is opened again.(Step S112 and S113). Accordingly, the opening speed of the window panel 30 is reduced in the vicinity of the magnet MA1, to resolve the problem that window panel 30 rams onto the window frame 10.

If the user release the window open button ◀ in the middle of opening the window panel again after the opening speed of the window panel 30 is reduced in the vicinity of the magnet MA1, the program proceeds from a step S114 to a step S115, to keep monitoring operation of the micro-switch sw14. If the micro-switch sw14 comes into operation (i.e., if the window panel is opened fully), the controller 73 proceeds the program from a step S114 to a step S116 to deactivate the solenoids 254 and to stop the motors M.

In the meantime, if it is intended to close the window panel 30 remotely by using the remote controller 60 from a state the window panel 30 is opened, the controller 73 determines the signal received presently of being a window close signal.(Step S121). If the user presses the window close button ▶ on the remote controller 60, the controller 73 activates the solenoids 254 in the window moving means 250, to rotate a free end of the holder 252*a* in the rotating force generating means 252 centered on a hinge 353 in a clockwise direction as shown in FIG. 14, until the worm 252*b* and the worm gear 253*b* are engaged. In this instance, the controller 73 activates the delay circuits 171*a* and 172*b*, so that putting the motors M into operation is delayed until the worm 152*b* and the worm gear 153*b* are engaged fully by the solenoids 254.(Step S122). Thus, when the delay time period during which the solenoids 254 are operative is passed, the controller 73 starts to rotate the motors M in the window moving means 250 in a state the worm 252*b* and the worm gear 253*b* are engaged, to close the window panel 30.(Step S123 and S124). If the lead switch sw2 fitted to the second window moving means 250*b* is activated during the window panel closing, though the program proceeds from a step S125 to a step S126, otherwise proceeds to a step S127, to wait for a signal from the lead switch sw12. That is, as far as the user does not release the window close button ▶ on the remote controller 60, though the window panel 30 is kept closing, if the window close button ▶ is released, the program ends, to stop the motors M and to deactivate the solenoids 54, to stop the window panel closing operation.

In the meantime, if the lead switch sw2 fitted to the window moving means 250*b* passes the magnet MA1 fitted to the window frame 10 during the closing of the window panel 30, the lead switch sw12 is turned on after the lead switch sw12 is turned off momentarily, when the motors M and the solenoids 54 are respectively rotated and activated after the motors M and the solenoids 54 are respectively stopped and deactivated. However, as described, as the motors M come into operation again later than the solenoid 54 by the delay time period by the delay circuits 171*a* and 171*b*, the window panel 30 is closed again.(Step 5128 and S129). Accordingly, the opening speed of the window panel 30 is reduced in the vicinity of the magnet MA2, to resolve the problem that window panel 30 rams onto the window frame 10. Thus, if the user release the window close button ▶ in the middle of closing the window panel again after the closing speed of the window panel 30 is reduced in the vicinity of the magnet MA2, the program proceeds from a step S130 to a step S131, to keep monitoring operation of the micro-switch sw15. If the micro-switch sw5 is activated (i.e., if the window panel is closed fully), the controller 73 proceeds the program from the step S130 to a step S132 to deactivate the solenoids 254 and to stop the motors M.

As explained, alike the first and the second embodiment of the present invention, the third embodiment of the present invention has the advantage of preventing the window panel from being rammed onto the window frame since the moving speed of the window panel can be reduced during the window panel is moving by means of the lead switch and the magnet.

Moreover, the third embodiment of the present invention has advantages in that repair of the window is smooth as an easy disassemble of the window from outside of the window is permitted without requiring to take away the large and heavy window from the window frame, and an effective anti-burglar function can be carried out as a visible or/and audible alarm signal can be issued when the window panel is forcibly opened from outside of the house in a state the window is closed fully.

Figure 19:
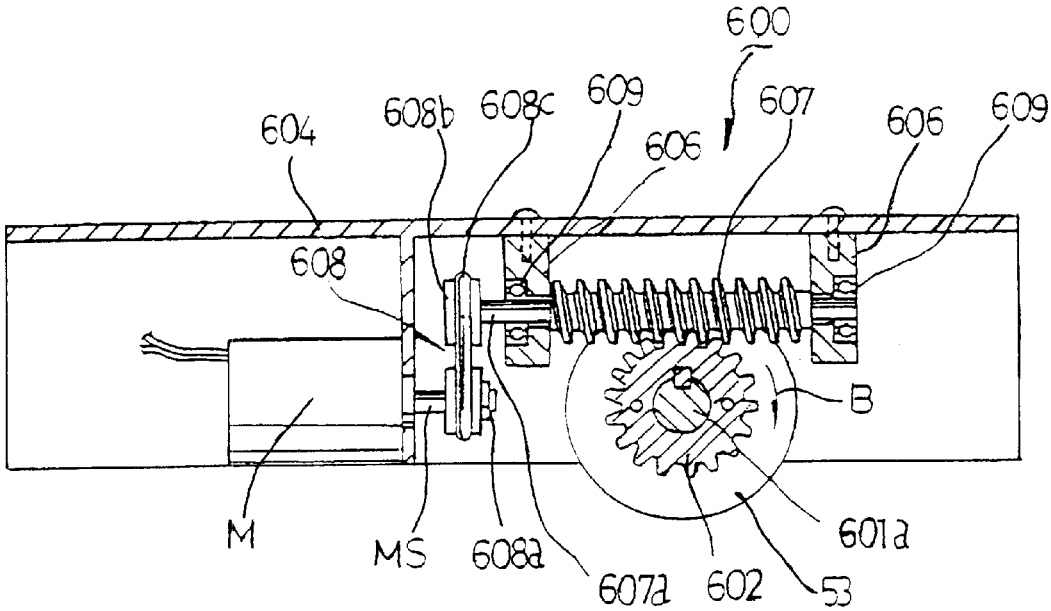
FIG. 19 illustrates a side, sectional, assembled view of an automatic window moving device in accordance with a fourth preferred embodiment of the present invention.
Figure 20:
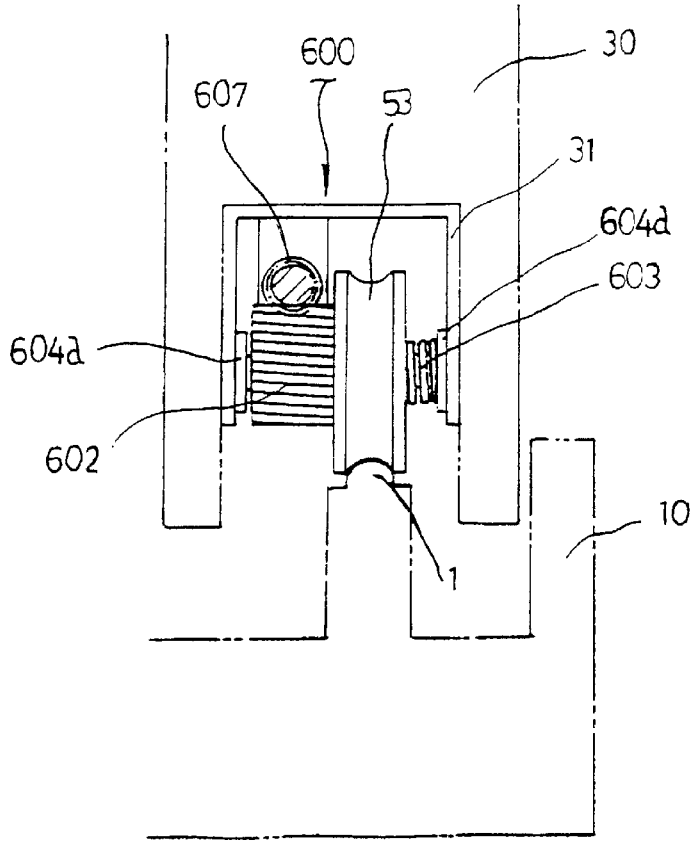
FIG. 20 illustrates a state of use of the automatic window moving device shown in FIG. 19; and, FIG. 21 illustrates a side, sectional, assembled view of an automatic window moving device in accordance with a fifth preferred embodiment of the present invention.

FIGS. 19 and 20 illustrate a device for automatic opening/closing a window in accordance with a fourth preferred embodiment of the present invention, which is a modified version from the third embodiment. In other word, there are two motors M with a worm W mounted on a rotation shaft MS thereof in the third embodiment, which requires a size of the window moving means 250 fitted to the window panel 30 to be relatively greater, and to synchronize the rotation speeds of the two motors M, a failure of which with a difference of rotation speed coming from inherent range of errors of respective motors causes overload of the motors, and the direct connection of the two motors at both ends of the rotation shaft MS causes much noise.

Accordingly, the fourth embodiment of the present invention modifies the drawback of the third embodiment. FIG. 19 illustrates a sectional, assembled view of a window moving device 600 used for an automatic window opening/closing system in accordance with a fourth preferred embodiment of the present invention, wherein parts identical to the parts in the third embodiment will be given the same reference numerals, and detailed explanations of which will be omitted. The window moving device 600 of the present invention may be fitted either in an upper groove 31 as shown in FIG. 1 or a lower groove 30 as shown in FIG. 20 of the window panel 30. In the following explanation, it is assumed that the window moving device 600 is fitted in the lower groove 31 of the window panel 30.

Referring to FIG. 20, the window moving device 600 is fitted in the lower groove 31 of the window panel 30, and receives a power from a power supply terminal(not shown) to move the window panel 30 with respect to the window frame 10. The window moving device 600 includes the window frame 10 having a rail 1, and a roller 53 on a rotating shaft 601*a* in a groove 31 of the window panel 30 for moving along the rail 1 of the window frame 10 in remote opening/closing the window 100 having window panes(see FIG. 1), wherein, as shown in FIG. 20, both ends of the rotating shaft 601*a* are inserted in brackets 604*a* fixed to both ends of a holder 604 by an appropriate method(for example, screw fastening), and, preferably, there is a bearing(not shown) mounted between the bracket 604*a* and the rotating shaft 601*a* for smooth rotation of the shaft 601*a*. The spring 603 in FIG. 20 leads the roller 53 to make an elastic forced surface contact with the worm gear 602, so that the roller 53 is guided by the rail 1 of the window frame 10, stably.

Referring to FIG. 19 again, the fourth embodiment has only one reversible motor M fitted to the holder 604, a worm 607 fitted to the bracket 606 of the holder 604 with the bearing 609 in between, and a worm gear 602 engaged with the worm 607 for being rotated by the worm 607. Accordingly, as shown in FIG. 19, in the fourth embodiment of the present invention, the rotating force from the motor M is made to be transmitted to the worm 607 through a rotating force transmission member 608 for making an overall size of the device more compact than the third embodiment, which has an advantage of preventing overload of the motor compared to one in which two motors are connected through the worm. For this, the rotating force transmission member 608 in the fourth embodiment has a first pulley 608*a* on the rotating shaft MS of the motor M, a second pulley 608*b* on a shaft 607*a* of the worm 607, and a belt 608*c* connected between the first pulley 608*a* and the second pulley 608*b* for transmission of a rotating force of the first pulley 608*a* to the second pulley 608*b*. Though it is preferable that the rotating force transmission member 608 has the pulleys 608*a* and 608*b*, and the belt 608*c*, the rotating force transmission member 608 may have others, such as gears mounted on the rotating shaft MS of the motor M and the shaft 607*a* of the worm 607, respectively.

In the aforementioned fourth embodiment of the present invention, if a user presses a power switch on a remote controller(not shown) when it is intended to open the window from a state the window panel 30 is closed, the motor M starts to rotate in a regular direction, together with the pulley 608*a* on the rotating shaft MS of the motor M shown in FIG. 19 as well as the pulley 608 through the belt 608*c* in the same direction with the pulley 608*a*, to rotate the worm gear 602 in a clockwise direction by the worm 607, and also to rotate the roller 53 brought into forced contact with the worm gear 602 in a direction of arrow B, thereby moving the window panel 30 is a right direction in FIG. 19. If the rotation direction of the motor M is made to be opposite by the remote controller, the operation will be made opposite to the foregoing description to move the window panel 30 is a left direction.

A case when it is intended to open or close the window, not by remotely, but by hand, will be explained. If the window panel is pushed with a force, the window will be opened as the roller 53 is rotated in a case the force is greater than the pressing force of the spring 603 even if the roller 53 is brought into forced contact with the worm gear 602 by the spring 603.

Figure 21:
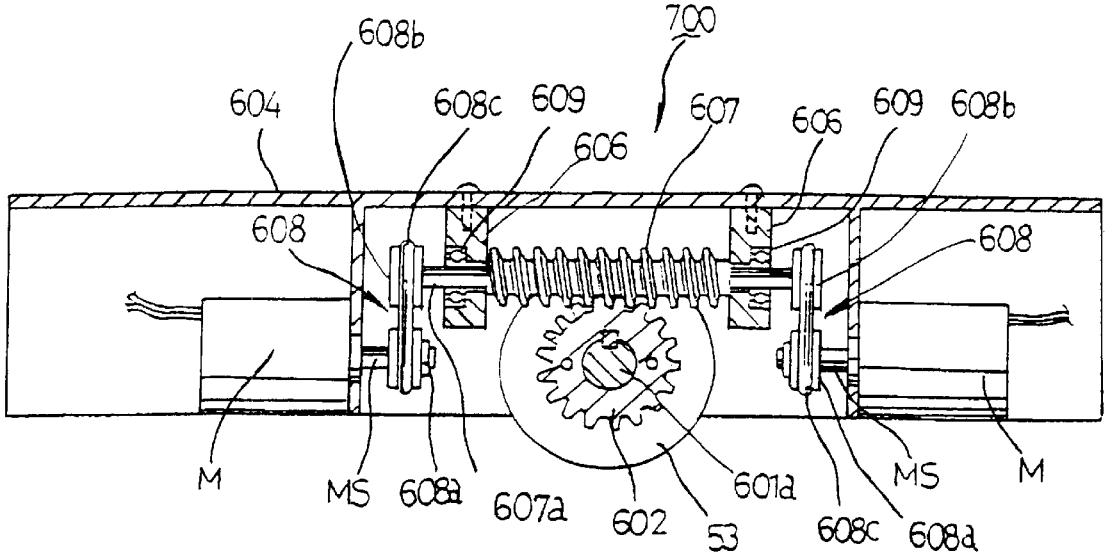

FIG. 21 illustrates a fifth preferred embodiment of the present invention, wherein parts identical to the parts in FIG. 19 will be given the same reference numerals, and detailed explanations of which will be omitted. Referring to FIG. 21, the fifth embodiment has one additional motor M fitted in the holder 604 to transmit a rotating force, as described before, to the worm 607 by the pulleys 608*a* and 608*b* and the belt 608*c* fitted thereto. Accordingly, though there is much noise occurred in the third embodiment as the worm is directly connected to respective motor shaft, there is almost no noise occurred in the fifth embodiment since the rotating force of the motor M is transmitted to the worm 607 indirectly through the pulleys 608*a*, 608*b* and the belt 608*c*.

INDUSTRIAL APPLICABILITY

As has been explained, the present invention has advantages in that a window can be opened/closed remotely from a distance by using the window open/close button on a remote controller, window can be opened/closed to a desired extent by releasing the window open/close button being pressed because the window is opened/closed only while the window open/close button on the remote controller is pressed, overload of the motor can be prevented because the power is turned off automatically by the microswitch when the window is opened/closed fully, and a anti-burglar function can be carried out because operation of no other locking device is not required during outing as the locker locks into the window frame automatically when the window is closed fully.

It will be apparent to those skilled in the art that various modifications and variations can be made in the remote controllable device for automatic opening/closing of a window of the present invention without departing from the spirit or scope of the invention. Thus, it is intended that the present invention cover the modifications and variations of this invention provided they come within the scope of the appended claims and their equivalents.

What is claimed is:

1. A remotely controllable device for automatic opening/closing of a window, including a window frame having a rail, and a window panel having a window pane, the window panel movable along the rail of the window frame, the remotely controllable device comprising:

a power supplying metal terminal for fitted along the rail of the window frame for receiving power;

window moving means fitted in a groove of the window panel for receiving power from the power supplying metal terminal to move the window panel with respect to the window frame;

a transmitter for transmitting a remote signal for controlling movement of the window panel remotely; and, a control means for receiving a control signal from the transmitter for controlling operation of the window moving means and wherein the window moving means includes:

a holder elastically fitted in the groove of the window panel;

at least one reversible motor fitted to the holder;

a driving member on the shaft fitted to the holder to be rotatable by a driving force of the motor;

a roller rotatably mounted on a same axis with the driving member to be guided by the rail of the window frame for moving the window panel with respect to the window frame;

a power supplying contact member fitted to the holder to be brought into elastic contact with the power supplying rail for supplying power to the motor; and an elastic member fitted in the groove of the window panel to support the holder elastically for stable guide of the roller along the rail of the window frame.

2. The remotely controllable device as claimed in claim 1, wherein the motor has a rotating shaft on which a worm is mounted, and the driving member is a worm gear engaged, and rotated with a worm mounted on the rotating shaft of the motor.

3. The remotely controllable device as claimed in claim 1, wherein the holder has two motors fitted thereto and rotating shafts of respective motors are coupled to each other with worms.

4. The remotely controllable device as claimed in claim 1, wherein the roller is rotated as the roller is brought into forced surface contact with the driving member on the shaft by an elastic force of the spring 53*a*.

5. The remotely controllable device as claimed in claim 1, wherein the driving member further includes:

a first permanent magnet fitted to one side of the driving member engaged; and rotated with a worm mounted on a rotating shaft of the motor; and a second permanent magnet fitted to one side of the roller facing the first permanent magnet for generating a magnetic force to the first permanent magnet;

thereby the roller and the driving member making a contactless rotation, to open the window panel by hand.

6. A remotely controllable device for automatic opening/closing of a window, including a window frame having a rail, a window panel having a window pane, the window panel movable along the rail of the window frame, and a power supplying metal terminal fitted along a rail of the window frame for receiving power, the remotely controllable device comprising:

window moving means detachably fitted on an outside edge of the window panel for receiving power from the power supplying metal terminal and rotating a roller guided along the rail of the window frame to move the window panel with respect to the window frame, automatically;

a transmitter for transmitting a remote signal for controlling movement of the window panel remotely; and, a control means for receiving a control signal from the transmitter for controlling operation of the window moving means.

7. The remotely controllable device as claimed in claim 6, wherein the window moving means includes first and second window moving means detachably fitted to a frame of a lower portion of the window panel at a leading edge and a following edge of the window panel for easy opening and closing of the window.

8. The remotely controllable device as claimed in claim 7, wherein each of the first and second window moving means includes:

a base member fixed to outside of the window panel;

rotating force generating means fixed to the base member having the other end rotatable centered on one end for generating a rotating force during automatic opening/closing of the window panel;

roller rotating means for transmitting the rotating force generated at the rotating force generating means to the roller to rotate the roller for automatic opening and closing of the window panel;

elevating means for engaging the rotating force generating means to the roller rotating means to transmit the rotating force from the rotating force generating means to the roller rotating means in automatic opening/closing of the window panel, and for disengaging the rotating force generating means from the roller rotating means for preventing the rotating force from the rotating force generating means from being transmitted to the roller rotating means to prevent the automatic or manual opening/closing of the window panel; and a cover for protecting the remotely controllable device from the outside elements.

9. The remotely controllable device as claimed in claim 8, wherein the base member includes:

a first base plate fitted to an outside of the window panel directly, and a second base plate spaced a distance from the first base plate, wherein a plurality of attenuating members fitted between the first base plate and the second base plate, for attenuating impact transmitted to the second base plate during opening/closing of the window panel.

10. The remotely controllable device as claimed in claim 8, wherein the rotating force generating means includes;

a holder fitted to the second base plate of the base member having one end centered on which the other end is rotatable;

at least one reversible motor for generating the rotating force in automatic opening/closing of the window panel 30;

a worm mounted on a rotating shaft of reversible motor; and an elevating rod fitted to the other end of the holder and connected to the elevating means.

11. The remotely controllable device as claimed in claim 8, wherein the roller rotating means includes:

a worm gear rotatably fitted to a bracket formed on the second base plate of the base member; and a rotating shaft fixed to the worm gear for rotating the roller.

12. The remotely controllable device as claimed in claim 8, wherein the elevating means includes a solenoid.

13. The remotely controllable device as claimed in claim 8, wherein each of the first and second window moving means further includes delay means for putting the rotating force generating means into operation for generating the rotating force after a preset time period is passed since the rotating force generating means is engaged with the roller rotating means by operating the elevating means first in an initial automatic opening/closing of the window panel.

14. The remotely controllable device as claimed in claim 7, further comprising window moving speed reducing means for reducing a moving speed of the window panel when the window panel is almost closed or opened in automatic opening/closing of the window panel by a remote controller, for preventing giving an excessive impact to the window.

15. A remote controllable device as claimed in claim 14, wherein the window moving speed reducing means includes:

first and second lead switches fitted to the window moving means, respectively; and first and second magnets fitted to the window frame.

16. The remotely controllable device as claimed in claim 15, further comprising a solenoid and at least one reversible motor, wherein operation of the motor and the solenoid is controlled by a signal sensed by the first lead switch in the first window moving means fitted to an open side of the window in opening the window panel by the transmitter, and operation of the motor and the solenoid is controlled by a signal sensed by the second lead switch in the second window moving means fitted to a close side of the window in closing the window panel by the transmitter.

17. The remotely controllable device as claimed in claim 6, wherein the window moving means is detachably fitted to an upper portion of an outside of the window panel, respectively.

18. The remotely controllable device as claimed in claim 6, further comprising window moving speed reducing means for reducing a moving speed of the window panel when the window panel is almost closed or opened in automatic opening/closing of the window panel by the remote controller, for preventing giving an excessive impact to the window.

19. A window moving device for use in a remotely controllable device for automatic opening/closing of a window, the remotely controllable device including a window frame having a rail, a roller rotatably fitted in a groove of a window panel having a window pane movable along the rail for opening/closing the window panel, and a spring for elastic surface contact pressing the roller to a worm gear for stable guide of the roller along the rail of the window frame, the window moving device comprising:

a holder fitted in a groove at a lower side of the window panel;

at least one reversible motor fitted to the holder;

a worm on a worm shaft mounted to a bracket on a holder for engagement with the worm gear for rotating the worm gear; and a rotating force transmitting member fitted to a rotating shaft of the motor and one end of the worm shaft.

20. The window moving device as claimed in claims 19, wherein the rotating force transmitting member includes:

a first pulley mounted on the rotating shaft of the motor;

a second pulley mounted on the worm; and a belt for connecting the first and second pulleys.

21. The window moving device as claimed in claim 19, wherein the rotating force transmitting member includes:

a first gear mounted on the rotating shaft of the motor; and a second gear fitted to the worm.

22. The window moving device as claimed in claim 19, having at two reversible motors and two rotating force transmitting members, wherein the two motors and the two rotating force transmitting members are fitted in the holder for rotating the worm.

* * * * *